US011691656B2

(12) United States Patent
Brooks et al.

(10) Patent No.: US 11,691,656 B2
(45) Date of Patent: Jul. 4, 2023

(54) VEHICLE CONTROL SYSTEM

(71) Applicant: Transportation IP Holdings, LLC, Norwalk, CT (US)

(72) Inventors: James D. Brooks, Schenectady, NY (US); Hullas Sehgal, Niskayuna, NY (US)

(73) Assignee: Transportation IP Holdings, LLC, Norwalk, CT (US)

( * ) Notice: Subject to any disclaimer, the term of this patent is extended or adjusted under 35 U.S.C. 154(b) by 104 days.

(21) Appl. No.: 17/315,836

(22) Filed: May 10, 2021

(65) Prior Publication Data

US 2021/0261178 A1 Aug. 26, 2021

Related U.S. Application Data

(63) Continuation of application No. 16/263,870, filed on Jan. 31, 2019, now Pat. No. 11,008,029, which is a (Continued)

(51) Int. Cl.
*B61L 23/34* (2006.01)
*B61L 25/02* (2006.01)
(Continued)

(52) U.S. Cl.
CPC ..... *B61L 23/34* (2013.01); *B61L 3/008* (2013.01); *B61L 23/007* (2013.01);
(Continued)

(58) Field of Classification Search
CPC ..... B61L 23/24; B61L 23/007; B61L 3/008; B61L 3/16; B61L 15/0009; B61L 2205/04; B61L 25/021; B61L 25/025
See application file for complete search history.

(56) References Cited

U.S. PATENT DOCUMENTS

2003/0122039 A1* 7/2003 Mollet ..... B61L 29/30 246/473 R
2004/0015275 A1* 1/2004 Herzog ..... B61L 25/025 701/19

(Continued)

FOREIGN PATENT DOCUMENTS

CA 2630045 A1 * 6/2007 ..... B61L 27/0094
CA 2617670 A1 * 7/2008 ..... B61L 29/32

OTHER PUBLICATIONS

JP 3022759 B2 with English translation. (Year: 2000).*

*Primary Examiner* — Calvin Cheung
(74) *Attorney, Agent, or Firm* — The Small Patent Law Group LLC; Philip S. Hof

(57) ABSTRACT

A system includes a locator device and one or more processors operably connected to the locator device. The locator device determines a trailing distance between a trailing vehicle system that travels along a route and a leading vehicle system that travels along the route ahead of the trailing vehicle system in a same direction of travel. The one or more processors compare the trailing distance to a first proximity distance relative to the leading vehicle system. In response to the trailing distance being less than the first proximity distance, the one or more processors set a permitted power output limit for the trailing vehicle system to be less than a maximum achievable power output for the trailing vehicle system, the permitted power output limit being set based on a power-to-weight ratio of the leading vehicle system.

20 Claims, 8 Drawing Sheets

Related U.S. Application Data continuation-in-part of application No. 15/705,752, filed on Sep. 15, 2017, now Pat. No. 10,246,111, which is a continuation of application No. 15/061,212, filed on Mar. 4, 2016, now Pat. No. 9,764,748.

(60) Provisional application No. 62/281,429, filed on Jan. 21, 2016.

(51) Int. Cl.

| | |
|---|---|
| ***B61L 23/00*** | (2006.01) |
| ***B61L 3/00*** | (2006.01) |
| *B61L 15/00* | (2006.01) |
| *B61L 3/16* | (2006.01) |

(52) U.S. Cl.

CPC ..... *B61L 25/021* (2013.01); *B61L 25/025* (2013.01); *B61L 3/16* (2013.01); *B61L 15/0009* (2013.01); *B61L 2205/04* (2013.01)

(56) References Cited

U.S. PATENT DOCUMENTS

| | | | | |
|---|---|---|---|---|
| 2004/0230354 | A1* | 11/2004 | Sollars | B61L 29/28 701/19 |
| 2008/0099633 | A1* | 5/2008 | Kane | B61L 25/021 246/124 |
| 2012/0001767 | A1* | 1/2012 | Ballinger | B61L 29/24 340/692 |
| 2013/0214097 | A1* | 8/2013 | Graber | B61L 29/246 246/174 |
| 2014/0166820 | A1* | 6/2014 | Hilleary | B61L 29/246 246/125 |
| 2014/0361125 | A1* | 12/2014 | Fries | B61L 29/04 246/473.1 |
| 2014/0367526 | A1* | 12/2014 | Steffen, II | B61L 25/021 246/126 |
| 2017/0096154 | A1* | 4/2017 | Hurst | G09B 9/04 |

* cited by examiner

800

| 802 Vehicle System | 804 HPT | 806 Rank |
|---|---|---|
| 702A | 2.0 | 4 |
| 702B | 3.0 | 2 |
| 702C | 2.5 | 3 |
| 702D | 1.5 | 5 |
| 702E | 4.0 | 1 |

VEHICLE CONTROL SYSTEM

CROSS-REFERENCE TO RELATED APPLICATIONS

This application is a continuation of U.S. patent application Ser. No. 16/263,870 (the "'870 Application"), filed 31 Jan. 2019. The '870 Application is a continuation in part of U.S. patent application Ser. No. 15/705,752 (the "'752 Application"), filed 15 Sep. 2017, issued as U.S. Pat. No. 10,246,111. The '752 Application is a continuation of U.S. patent application Ser. No. 15/061,212 (the "'212 Application"), filed 4 Mar. 2016, issued as U.S. Pat. No. 9,764,748. The '212 Application claims priority to U.S. Provisional Application No. 62/281,429 (the "'429 Application"), filed 21 Jan. 2016. The entire disclosures of the '870 Application, the '752 Application, the '212 Application, and the '429 Application are incorporated herein by reference.

FIELD

Embodiments of the subject matter described herein relate to vehicle control systems, and more particularly, to controlling a vehicle system relative to other vehicles, crossings, and/or work zones.

BACKGROUND

A vehicle transportation system may include multiple vehicles that travel on the same routes. The vehicles may have different characteristics, such as power outputs and weights, that affect how quickly the vehicles can navigate through the routes. A trailing vehicle traveling along a given route may reduce the distance between the trailing vehicle and a vehicle ahead along the same route that travels slower. The trailing vehicle has an incentive to reduce the total trip time in order to meet a designated arrival time at a destination, improve fuel economy, reduce emissions, and the like. However, if the trailing vehicle travels too closely to the vehicle ahead, the trailing vehicle may be required to slow to a stop for a designated period of time in order to avoid a risk of an accident between the two vehicles. The stop is undesirable as it may result in a significant delay and reduce fuel economy.

At least some of the routes over which vehicles travel may cross routes of other transportation systems, such as where rail tracks and road or highway systems cross over each other. To warn the vehicles of the other transportation systems, a vehicle approaching a crossing may be configured to activate a warning sound that is audible to people and animals near the crossing. Typically, the operator of a vehicle controls the warning sound in addition to other duties of the operator. It is not uncommon for the operator to make mistakes, such as to forget to activate the warning sound at the proper time, to activate the warning sound when not warranted (e.g., when the vehicle is in a quiet zone), or the like.

BRIEF DESCRIPTION

In one or more embodiments, a system (e.g., a vehicle control system) includes a locator device, a communication circuit, and one or more processors. The locator device is disposed onboard a trailing vehicle system that is configured to travel along a route behind a leading vehicle system that travels along the route in a same direction of travel as the trailing vehicle system. The locator device is configured to determine a location of the trailing vehicle system along the route. The communication circuit is disposed onboard the trailing vehicle system. The communication circuit is configured to periodically receive a status message that includes a location of the leading vehicle system. The one or more processors are onboard the vehicle system and are operably connected to the locator device and the communication circuit. The one or more processors are configured to verify that a power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The one or more processors are further configured to monitor a trailing distance between the trailing vehicle system and the leading vehicle system based on the respective locations of the leading and trailing vehicle systems. Responsive to the trailing distance being less than a first proximity distance relative to the leading vehicle system, the one or more processors are configured to set an upper permitted power output limit for the trailing vehicle system that is less than the upper power output limit of the trailing vehicle system to reduce an effective power-to-weight ratio of the trailing vehicle system.

In one or more embodiments, a method (e.g., for controlling movement of a trailing vehicle system) includes determining a power-to-weight ratio of a leading vehicle system that is on a route and disposed ahead of a trailing vehicle system on the route in a direction of travel of the trailing vehicle system. The method includes verifying that the power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The method also includes monitoring a trailing distance between the trailing vehicle system and the leading vehicle system along the route. The method further includes, responsive to the trailing distance being less than a first proximity distance relative to the leading vehicle system, setting an upper permitted power output limit that is less than the upper power output limit. An effective power-to-weight ratio of the trailing vehicle system based on the upper permitted power output limit is no greater than the power-to-weight ratio of the leading vehicle system.

In one or more embodiments, a system (e.g., vehicle control system) is provided that includes a communication device and one or more processors operably connected to the communication device. The communication device is located offboard multiple vehicle systems scheduled to travel along a segment of a route within a predetermined time period. The one or more processors are configured to set a permitted power output per weight limit for the vehicle systems. The permitted power output per weight limit is less than a maximum achievable power output per weight of at least one of the vehicle systems. The permitted power output per weight limit is set based on a predetermined power output per weight, one or more route characteristics of the segment of the route, and/or the maximum achievable power output per weight of one or more of the vehicle systems. The permitted power output per weight limit is enforced as a function of time, distance, and/or location along the route. The communication device is configured to communicate the permitted power output per weight limit to the vehicle systems such that the vehicle systems traveling along the segment of the route do not exceed the permitted power output per weight limit while the permitted power output per weight limit is enforced.

In one or more embodiments, a method (e.g., for controlling movement of vehicle systems) is provided that includes identifying multiple vehicle systems scheduled to travel along a segment of a route within a predetermined time period, and determining a maximum achievable power output per weight of each of the vehicle systems. The method also includes setting a permitted power output per weight limit for the segment of the route. The permitted power output per weight limit is less than the maximum achievable power output per weight of at least one of the vehicle systems and is set based on the maximum achievable power output per weight of one or more of the vehicle systems. The method includes communicating the permitted power output per weight limit to the vehicle systems such that the vehicle systems do not exceed the permitted power output per weight limit while the vehicle systems travel along the segment of the route and the permitted power output per weight limit is enforced.

In one or more embodiments, a system (e.g., vehicle control system) is provided that includes a network controller including one or more processors. The network controller is configured to identify multiple vehicle systems scheduled to travel along a segment of a route within a predetermined time period and determine a maximum achievable power output per weight of each of the vehicle systems. The network controller is further configured to set a permitted power output per weight limit for the segment of the route. The permitted power output per weight limit is set based on the maximum achievable power output per weight of one or more of the vehicle systems and is less than the maximum achievable power output per weight of at least one of the vehicle systems. The system also includes a communication device operably connected to the network controller. The communication device is configured to communicate the permitted power output per weight limit to the vehicle systems such that the vehicle systems implement the permitted power output per weight limit while traveling along the segment of the route.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
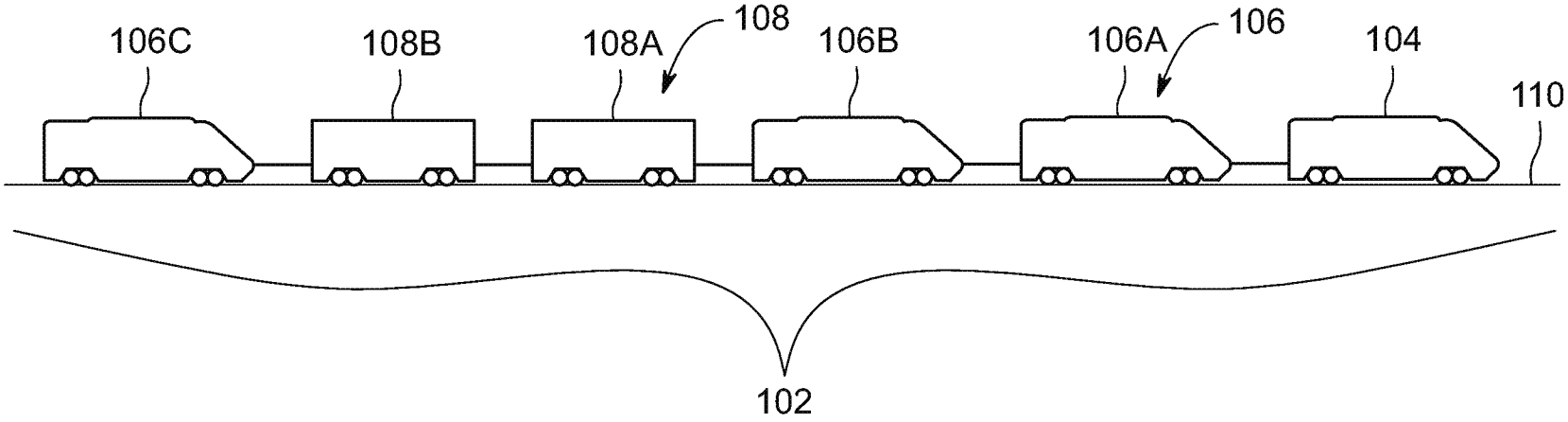
FIG. 1 illustrates a vehicle system in accordance with an embodiment.

One or more embodiments of the inventive subject matter described herein provide systems and methods for improved control of a vehicle system along a route. In various embodiments, an onboard system is provided that is configured to control movement of a vehicle system on a route relative to a vehicle ahead along the same route that is moving in the same direction. For example, the onboard system paces the vehicle system based on an acceleration capability of the vehicle ahead such that the vehicle system does not travel within a designated range of the vehicle ahead, which would require the vehicle system to stop or at least slow to increase the distance between the vehicles. A technical effect of such pacing is an increased overall throughput and efficiency along a network of routes as the trailing vehicle system is able to travel at a trailing distance behind the vehicle ahead that may be less than a trailing distance of the trailing vehicle system according to conventional pacing methods, such as relying on block signal aspects as described in more detail herein. Furthermore, such pacing increases the overall throughput and efficiency by avoiding delays that occur as a result of the trailing vehicle system traveling too closely to the vehicle ahead, which mandates that the trailing vehicle system slow to a stop or a low non-zero speed for a period of time before being allowed to accelerate up to a desired speed again. The stops and/or reduced speeds of the trailing vehicle system increase the travel time of the trailing vehicle system along the route and decrease the travel efficiency (e.g., increased fuel consumption, increased noise and exhaust emissions, etc.).

In various other embodiments, an onboard system is provided that is configured to control movement of a vehicle system on a route relative to an upcoming grade crossing. For example, the onboard system may operate an audible warning automatically without operator input as the vehicle system approaches the grade crossing. The characteristics of the audible warning, such as whether or not to activate the warning, the volume of the warning, the start and end times of the warning, etc., are controlled by the onboard system. A technical effect of such automatic warning is a reduced operational load on the operator of the vehicle system and more consistent and accurate warning activations due to reduced human-involvement.

Various other embodiments described herein provide an onboard system that is configured to control movement of a vehicle system on a route relative to work zones and other special areas of interest along the route. For example, the onboard system may be configured to automatically update a trip plan according to which the vehicle system is traveling based on a received order, such as a temporary slow order. A technical effect of such automatic adjustment of the trip plan is improved control of the vehicle system through the special areas of interest.

Various other embodiments described herein provide an onboard system that is configured to automatically display improved information to an operator of a vehicle system. For example, the onboard system may display (on an onboard visual display) information about a route aspect, such as an upcoming signal. The information for an upcoming signal may include a distance to the signal, a time of arrival to the signal, a status of the signal (e.g., red over green indication, red over yellow indication, or green over green indication), the aspect of the signal (e.g., approach medium, clear, etc.), a type of the signal, and a physical layout of the signal. A technical effect of such automatic display of this improved information is allowing the operator to have advanced knowledge of the information prior to the vehicle system traveling within eyesight distance of the route aspect.

These and other embodiments are described in more detail herein with reference to the accompanying figures.

FIG. 1 illustrates one example of a vehicle system 102, in accordance with an embodiment. The illustrated vehicle system 102 includes propulsion-generating vehicles 104, 106 (e.g., vehicles 104, 106A, 106B, 106C) and non-propulsion-generating vehicles 108 (e.g., vehicles 108A, 108B) that travel together along a route 110. Although the vehicles 104, 106, 108 are shown as being mechanically coupled with each other, the vehicles 104, 106, 108 alternatively may not be mechanically coupled with each other. For example, at least some of the vehicles 104, 106, 108 may not be mechanically coupled to each other, but are still operatively coupled to each other such that the vehicles 104, 106, 108 travel together along the route 110 via a communication link or the like. The number and arrangement of the vehicles 104, 106, 108 in the vehicle system 102 are provided as one example and are not intended as limitations on all embodiments of the subject matter described herein. In the illustrated embodiment, the vehicle system 102 is shown as a rail vehicle system (e.g., train) such that the propulsion-generating vehicles 104, 106 are locomotives and the non-propulsion-generating vehicles 108 are rail cars. But, in other embodiments, the vehicle system 102 may be an aircraft, a water vessel, an automobile, or an off-highway vehicle (e.g., a vehicle system that is not legally permitted and/or designed for travel on public roadways).

Optionally, groups of one or more adjacent or neighboring propulsion-generating vehicles 104 and/or 106 may be referred to as a vehicle consist. For example, the vehicles 104, 106A, 106B may be referred to as a first vehicle consist of the vehicle system 102 and the vehicle 106C referred to as a second vehicle consist of the vehicle system 102. The propulsion-generating vehicles 104, 106 may be arranged in a distributed power (DP) arrangement. For example, the propulsion-generating vehicles 104, 106 can include a lead vehicle 104 that issues command messages to the other propulsion-generating vehicles 106A, 106B, 106C, which are referred to herein as remote vehicles. The designations "lead" and "remote" are not intended to denote spatial locations of the propulsion-generating vehicles 104, 106 in the vehicle system 102, but instead are used to indicate which propulsion-generating vehicle 104, 106 is communicating (e.g., transmitting, broadcasting, or a combination of transmitting and broadcasting) command messages and which propulsion-generating vehicles 104, 106 are receiving the command messages and being remotely controlled using the command messages. For example, the lead vehicle 104 may or may not be disposed at the front end of the vehicle system 102 (e.g., along a direction of travel of the vehicle system 102). Additionally, the remote vehicles 106A-C need not be separated from the lead vehicle 104. For example, a remote vehicle 106A-C may be directly coupled with the lead vehicle 104 or may be separated from the lead vehicle 104 by one or more other remote vehicles 106A-C and/or non-propulsion-generating vehicles 108.

Figure 2:
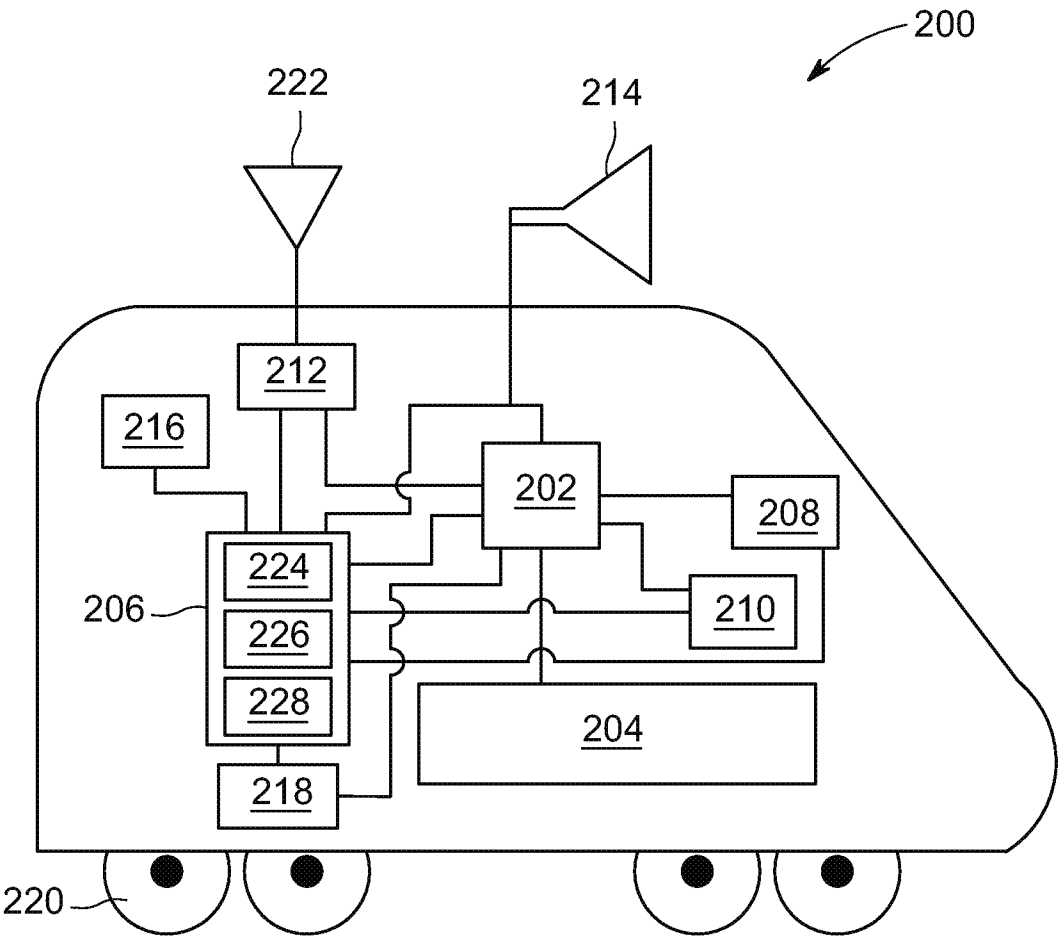
FIG. 2 is a schematic diagram of a vehicle system according to an embodiment.

FIG. 2 is a schematic diagram of a vehicle system 200 according to an embodiment. The vehicle system 200 may be a portion of the vehicle system 102 shown in FIG. 1. For example, the illustrated vehicle in FIG. 2 may be one of the propulsion-generating vehicles 104, 106 shown in FIG. 1. The vehicle system 200 in the illustrated embodiment includes a vehicle controller 202, a propulsion system 204, a trip planning controller 206, a display device 208, a manual input device 210, a communication circuit 212, an audible warning emitter 214, a locator device 216, and speed sensor 218. The vehicle system 200 may include additional components, fewer components, and/or different components than the illustrated components in other embodiments. Although all of the components of the vehicle system 200 in the illustrated embodiment are located on the same vehicle, optionally at least some of the components are distributed among plural vehicles of the vehicle system 200.

The vehicle controller 202 controls various operations of the vehicle system 200. The controller 202 may include or represent one or more hardware circuits or circuitry that include and/or are connected with one or more processors, controllers, or other hardware logic-based devices. For example, the controller 202 in an embodiment has one or more processors. The controller 202 is operatively connected with the propulsion system 204 in order to control the propulsion system 204. The propulsion system 204 may provide both propelling efforts and braking efforts for the vehicle system 200. The controller 202 may be configured to generate control signals autonomously or based on manual input that is used to direct operations of the propulsion system 204, such as to control a speed of the vehicle system 200. The vehicle controller 202 optionally may also control auxiliary loads of the vehicle system 200, such as heating, ventilation, and air-conditioning (HVAC) systems, lighting systems, and the like.

The propulsion system 204 includes propulsion-generating components, such as motors, engines, generators, alternators, turbochargers, pumps, batteries, turbines, radiators, and/or the like, that operate to provide power generation under the control implemented by the controller 202. The propulsion system 204 provides tractive effort to power wheels 220 of the vehicle system 200 to move the vehicle system 200 along the route. In another embodiment, the propulsion system 204 may include tracks that engage the route instead of the wheels 220 shown in FIG. 2. In a marine vessel embodiment, the propulsion system 204 may include one or more propellers instead of the wheels 220 to propel the vehicle system 200 through the water. The propulsion system 204 also includes brakes and affiliated components that are used to slow the vehicle system 204.

The speed sensor 218 is configured to monitor a speed of the vehicle system 200 along the route. The speed sensor 218 may monitor the speed by measuring the movement of one or more components, such as the rotational speed of one of the wheels 220 that engage the route, the rotational speed of a drive shaft (not shown), or the like. The speed sensor 218 is communicatively connected to the vehicle controller 202 and/or the trip planning controller 206 to communicate speed measurement signals for analysis. Although only the speed sensor 218 is shown in FIG. 2, the vehicle system 200 may include additional sensors (not shown), such as additional speed sensors, pressure sensors, temperature sensors, position sensors, gas and fuel sensors, acceleration sensors, and/or the like. The sensors are configured to acquire operating parameters of various components of the vehicle system 200 and communicate data measurement signals of the operating parameters to the vehicle controller 202 and/or the trip planning controller 206 for analysis.

The display device 208 is configured to be viewable by an operator of the vehicle system 200, such as a conductor or engineer. The display device 208 includes a display screen, which may be a liquid crystal display (LCD), a light emitting diode (LED) display, an organic light emitting diode (OLED) display, a plasma display, a cathode ray tube (CRT) display, and/or the like. The display device 208 is communicatively connected to the vehicle controller 202 and/or the trip planning controller 206. For example, the vehicle controller 202 and/or the trip planning controller 206 can present information to the operator via the display device 208, such as status information, operating parameters, a map of the surrounding environment and/or upcoming segments of the route, notifications regarding speed limits, work zones, and/or slow orders, and the like.

The manual input device 210 is configured to obtain manually input information from the operator of the vehicle system 200, and to convey the input information to the vehicle controller 202 and/or the trip planning controller 206. The manually input information may be an operator-provided selection, such as a selection to limit the throttle settings of the vehicle system 200 along a segment of the route due to a received slow order, for example. The operator-provided selection may also include a selection to activate the audible warning emitter 214, to control the communication circuit 212 to communicate a message remotely to another vehicle, to a dispatch location, or the like, or to actuate the brakes to slow and/or stop the vehicle system 200. The manual input device 210 may be a keyboard, a touchscreen, an electronic mouse, a microphone, a wearable device, or the like. Optionally, the manual input device 210 may be housed with the display device 208 in the same case or housing. For example, the input device 210 may interact with a graphical user interface (GUI) generated by the vehicle controller 202 and/or the trip planning controller 206 and shown on the display device 206.

The communication circuit 212 is operably connected to the vehicle controller 202 and/or the trip planning controller 206. The communication circuit 212 may represent hardware and/or software that is used to communicate with other devices and/or systems, such as remote vehicles or dispatch stations. The communication circuit 212 may include a transceiver (or discrete transmitter and receiver components), an antenna 222, and associated circuitry for wireless bi-directional communication of various types of messages, such as linking messages, command messages, reply messages, status messages, and/or the like. The communication circuit 212 may be configured to transmit messages to specific designated receivers and/or to broadcast messages indiscriminately. Optionally, the communication circuit 212 also includes circuitry for communicating messages over a wired connection, such as an electric multiple unit (eMU) line (not shown) between vehicles of a vehicle system 200, a catenary line or conductive rail of a track, or the like.

The locator device 216 is configured to determine a location of the vehicle system 200 along the route. The locator device 216 may be a GPS receiver or a system of sensors that determine a location of the vehicle system 200. Examples of such other systems include, but are not limited to, wayside devices, such as radio frequency automatic equipment identification (RF AEI) tags and/or video-based determinations. Another system may use a tachometer and/or speedometer aboard a propulsion-generating vehicle and distance calculations from a reference point to calculate a current location of the vehicle system 200. The locator device 216 may be used to determine the proximity of the vehicle system 200 along the route from one or more crossings in the route, from one or more other vehicles on the route, from a work zone or another speed-restricted zone, from a quiet zone, or the like.

The audible warning emitter 214 is configured to provide an audible warning sound to alert people and animals of the approaching vehicle system 200. The audible warning emitter 214 may be a horn, a speaker, a bell, a whistle, or the like. The audible warning emitter 214 is operably controlled automatically by the vehicle controller 202 and/or the trip planning controller 206. The emitter 214 may be controlled manually by the operator using the manual input device 210. The manual control of the emitter 214 may override the automatic control of the emitter 214. For example, the operator is able to activate the emitter 214 when the emitter 214 is being automatically controlled by the controller 202 and/or the controller 206.

The trip planning controller 206 of the vehicle system 200 may be configured to receive, generate, and/or implement a trip plan that controls movements of the vehicle system 200 along the route to improve one or more operating conditions while abiding by various prescribed constraints. The trip planning controller 206 includes one or more processors 224, such as a computer processor or other logic-based device that performs operations based on one or more sets of instructions (e.g., software). The instructions on which the controller 206 operates may be stored on a tangible and non-transitory (e.g., not a transient signal) computer readable storage medium, such as a memory 226. The memory 226 may include one or more computer hard drives, flash drives, RAM, ROM, EEPROM, and the like. Alternatively, one or more of the sets of instructions that direct operations of the controller 206 may be hard-wired into the logic of the controller 206, such as by being hard-wired logic formed in the hardware of the controller 206.

The trip planning controller 206 may receive a schedule from an off-board scheduling system. The trip planning controller 206 may be operatively coupled with, for example, the communication circuit 212 to receive an initial and/or modified schedule from the scheduling system. In an embodiment, the schedules are conveyed to the controller 206, and may be stored in the memory 226. Alternatively, the schedule may be stored in the memory 226 of the trip planning controller 206 via a hard-wired connection, such as before the vehicle system 200 starts on a trip along the route. The schedule may include information about the trip, such as the route to use, the departing and destination locations, the desired total time of travel, the desired arrival time at the destination location and optionally at various checkpoint locations along the route, the location and time of any meet and pass events along the route, and the like.

In an embodiment, the trip planning controller 206 (including the processors 224 thereof) generates a trip plan based on the schedule. The trip plan may include throttle settings, brake settings, designated speeds, or the like, of the vehicle system 200 for various segments of the route during a scheduled trip or mission of the vehicle system 200 to the scheduled destination location. The trip plan may be generated to reduce the amount of fuel that is consumed by the vehicle system 200 and/or the amount of emissions generated by the vehicle system 200 as the vehicle system 200 travels to the destination location relative to travel by the vehicle system 200 to the destination location when not abiding by the trip plan. Controlling the vehicle system 200 according to the trip plan may result in the vehicle system 200 consuming less fuel and/or generating fewer emissions to reach a destination location than if the same vehicle system 200 traveled along the same routes to arrive at the same destination location at the same time as the trip plan (or within a relatively small time buffer, such as one to three or five percent of the total trip time, or another relatively small percentage), but traveling at speed limits (e.g., track speed) of the routes.

In order to generate the trip plan for the vehicle system 200, the trip planning controller 206 can refer to a trip profile that includes information related to the vehicle system 200, information related to a route over which the vehicle system 200 travels to arrive at the scheduled destination, and/or other information related to travel of the vehicle system 200 to the scheduled destination location at the scheduled arrival time. The information related to the vehicle system 200 may include information regarding the fuel efficiency of the vehicle system 200 (e.g., how much fuel is consumed by the vehicle system 200 to traverse different sections of a route), the tractive power (e.g., horsepower) of the vehicle system 200, the weight or mass of the vehicle system 200 and/or cargo, the length and/or other size of the vehicle system 200, the location of powered units in the vehicle system 200, and/or other information. The information related to the route to be traversed by the vehicle system 200 can include the shape (e.g., curvature), incline, decline, and the like, of various sections of the route, the existence and/or location of known slow orders or damaged sections of the route, and the like. Other information can include information that impacts the fuel efficiency of the vehicle system 200, such as atmospheric pressure, temperature, precipitation, and the like. The trip profile may be stored in the memory 226 of the trip planning controller 206.

The trip plan is formulated by the trip planning controller 206 (e.g., by the one or more processors 224) based on the trip profile. For example, if the trip profile requires the vehicle system 200 to traverse a steep incline and the trip profile indicates that the vehicle system 200 is carrying significantly heavy cargo, then the one or more processors 224 may generate a trip plan that includes or dictates increased tractive efforts for that segment of the trip to be provided by the propulsion system 204 of the vehicle system 200. Conversely, if the vehicle system 200 is carrying a smaller cargo load and/or is to travel down a decline in the route based on the trip profile, then the one or more processors 224 may form a trip plan that includes or dictates decreased tractive efforts by the propulsion system 204 for that segment of the trip. In an embodiment, the trip planning controller 206 includes a software application or system such as the Trip Optimizer™ system provided by General Electric Company. The trip planning controller 206 may directly control the propulsion system 204, may indirectly control the propulsion system 204 by providing control commands to the vehicle controller 202, and/or may provide prompts to an operator for guided manual control of the propulsion system 204.

The trip planning controller 206 further includes a clock 228 that is synchronized to a common timing scheme. In some embodiments, the clock 228 may be operatively connected to a GPS receiver of the locator device 216 to provide an absolute time based on a GPS signal. The clock 228 provides the trip planning controller 206 with information about the time of day.

In the illustrated embodiment, the one or more processors 224, the memory 226, and the clock 228 are all contained within the trip planning controller 206. In one embodiment, the processor(s) 224, the memory 226, and the clock 228 are all housed within a common hardware housing or case. In an alternative embodiment, however, these components are not all housed within a common housing, such that at least one of the processor(s) 224, the memory 226, or the clock 228 is disposed in a separate housing or case from the other component(s) of the trip planning controller 206.

Figure 3:
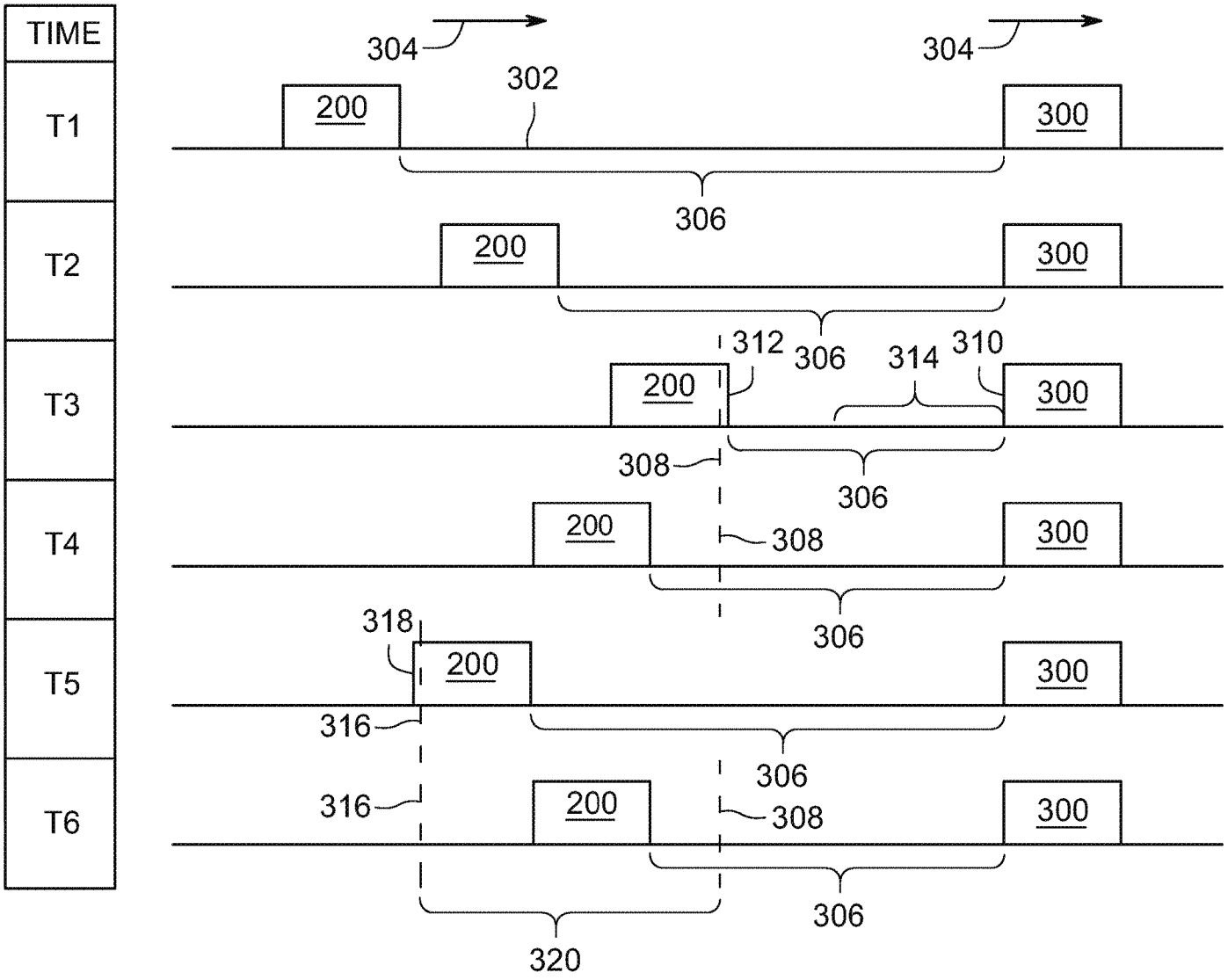
FIG. 3 is a schematic diagram showing a trailing vehicle system and a leading vehicle system ahead of the trailing vehicle system along a route at different times during a trip of the trailing vehicle system.
Figure 4:
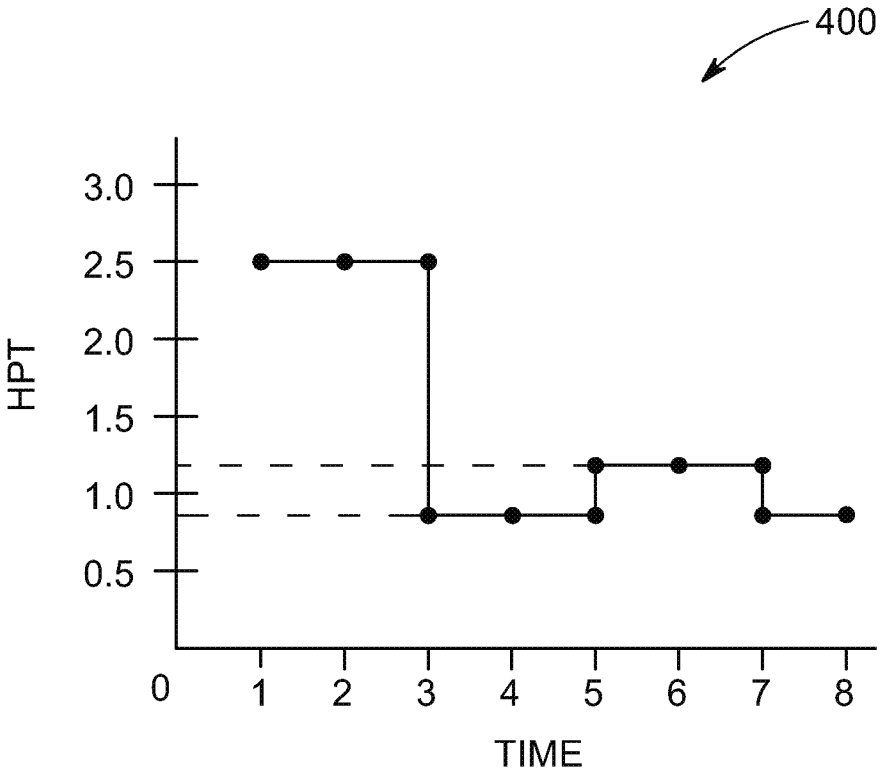
FIG. 4 is a graph of horsepower per tonnage (HPT) of the vehicle system over time during the trip of the vehicle system shown in FIG. 3.

FIG. 3 is a schematic diagram showing the vehicle system 200 and a leading vehicle system 300 ahead of the vehicle system 200 along a route 302 at different times during a trip of the vehicle system 200. FIG. 4 is a graph 400 of horsepower per tonnage (referred to herein as "HPT") of the vehicle system 200 over time during the trip of the vehicle system 200 shown in FIG. 3. The information presented in FIGS. 3 and 4 is merely for illustration and is not intended to be limiting.

The HPT of the vehicle system 200 is a performance indicator of the vehicle system 200. The HPT is a power-to-weight ratio, or power output per weight, that indicates an acceleration capability of the vehicle system 200. The HPT is calculated as the total available (e.g., maximum achievable) power output of a vehicle system divided by the weight or tonnage of the vehicle system. The total power output of the vehicle system is determined as the sum of the maximum available or achievable horsepower provided by the propulsion system (such as the propulsion system 204 shown in FIG. 2) of each propulsion-generating vehicle in the vehicle system. For example, a vehicle system having two propulsion-generating vehicles that each can provide 6,000 horsepower (e.g., 4500 kW), as a maximum achievable power output, has a total vehicle system horsepower of 12,000. The weight or tonnage of the vehicle system is the total weight of the vehicle system along the route, which is the sum of the weight of each of the vehicles in the vehicle system including weight attributable to cargo and/or passengers. For example, a vehicle system that includes two propulsion generating vehicles that each weigh 250 tons and fifty-five non-propulsion generating vehicles that each weigh 100 tons would have an HPT of 2.0 (e.g., calculated as $12{,}000/((2\times 250)+(55\times 100))=2.0$ HP/T). Since the HPT is determined as a function of both power and weight, a first vehicle system that has twice the horsepower and also twice the weight as a second vehicle system would have the same HPT as the second vehicle system. Instead of horsepower over tonnage, the power-to-weight ratio can be represented as horsepower over pounds, kilowatts over kilograms, or the like.

A higher HPT indicates a greater acceleration capability and/or speed than a lower HPT. For example, a first vehicle system with a higher HPT than a second vehicle system would be able to traverse up a hill faster than the second vehicle system because the first vehicle system is able to generate a greater acceleration up the hill. The HPT can also affect the total travel time for a given trip. For example, the first vehicle system having the greater HPT would be able to traverse a given route faster than the second vehicle system, resulting in a greater average speed and a lower total travel time than the second vehicle system. Therefore, a trailing vehicle system that has a greater HPT than a leading vehicle system traveling along the same route ahead of the trailing vehicle system has the ability to travel faster than the leading vehicle, at least along flat and inclined segments of the route. The trailing vehicle system may travel at a greater actual or effective power-to-weight ratio than the leading vehicle system, which causes the trailing vehicle to reduce the gap or trailing distance that separates the two vehicle systems.

Assuming there is no meet and pass event scheduled, if the trailing vehicle system gets too close to the leading vehicle system ahead, as a safety precaution the trailing vehicle system may be required by regulation to slow to a stop or a significantly low speed (e.g., 2 miles per hour (mph), 5 mph, 10 mph, or the like) in order to increase the gap between the two vehicle systems. Forcing the trailing vehicle system to come to a stop or to slow to a significantly low speed is inefficient as it lowers throughput along the route, reduces fuel economy of the trailing vehicle system, increases the length of time of the trip of the trailing vehicle system, and/or the like. Prior to being forced to slow and/or stop, the trailing vehicle system may have been traveling over the route according to a designated trip plan that is configured to reduce energy consumption, emissions, noise, travel time, and/or the like. The trip plan may not have accounted for the leading vehicle system traveling slower along the route. The requirement for the trailing vehicle system to slow and/or stop due to proximity to the leading vehicle system causes the trailing vehicle system to deviate from the designated trip plan until the trailing vehicle system is allowed to return to speed.

In one or more embodiments described herein, the trip planning controller 206 (shown in FIG. 2) of the vehicle system 200 is configured to account for vehicle systems ahead of the vehicle system 200 along the same route that have a lower HPT than the vehicle system 200. For example, the trip planning controller 206 is able to pace the vehicle system 200 based on the leading vehicle system ahead of the vehicle system 200. The adopted pace of the vehicle system 200 is likely slower overall than the speed profile at which the vehicle system 200 would traverse the route without a leading vehicle system on the route, but the pace of the vehicle system 200 is designed to avoid the need to stop and/or slow to a significantly low speed. Thus, the total travel time, fuel consumption, and/or emissions would likely be lower by pacing than if the vehicle system 200 travels according to a designated trip plan that does not account for the leading vehicle and results in the vehicle system 200 being forced to stop and/or slow considerably at least once during the trip.

FIG. 3 shows the vehicle system 200 and the vehicle system 300 along the route 302 at six different times (e.g., T1, T2, T3, T4, T5, T6) during a trip of the vehicle system 200. Both vehicle systems 200, 300 travel in the same direction 304 along the route 302. The vehicle system 300 is referred to as the leading vehicle system 300, and the vehicle system 200 is referred to as the trailing vehicle system 200. FIG. 3 shows how the relative distance between the leading and trailing vehicle systems 300, 200 changes over time. Thus, although the leading vehicle system 300 is shown in the same location at each time, it is assumed that the leading vehicle system 300 is constantly moving and therefore the location of the vehicle system 300 relative to the route 302 is different at each time. The distance between the leading vehicle system 300 and the trailing vehicle system 200 is referred to as the trailing distance 306 or gap. The different times may represent various increments of time, such as minutes, hours, or tens of hours. For example, the time that elapses between times T1 and T2 may be one hour, two hours, five hours, or the like. The time increments may be constant between times T1 and T6, but optionally are not constant.

In the illustrated embodiment, the leading vehicle system 300 has an HPT of 1.0 and the trailing vehicle system 200 has an HPT of 2.5. Therefore, the power-to-weight ratio or power output per weight of the trailing vehicle system 200 is greater than the power-to-weight ratio of the leading vehicle system 300. These values represent the capabilities of these vehicle systems 200, 300. For example, the HPT of 2.5 corresponds to an upper power output limit (e.g., a maximum achievable power output per weight) of the trailing vehicle system 200. The trailing vehicle system 200 cannot exert more horsepower than the 2.5 times the weight of the vehicle system 200. Likewise, the leading vehicle system 300 cannot exceed the 1.0 power-to-weight ratio.

It is recognized that each of the vehicle systems 200, 300 may travel along different segments of the route at different power outputs depending on route characteristics and other factors, such that the vehicle systems 200, 300 may often provide a current power output that is less than the respective upper power output limit. For example, the trailing vehicle system 200 may have an upper power output limit of 12,000 horsepower, but generates less than 12,000 horsepower along various segments of the route according to the trip plan. The trip plan designates throttle and brake settings of the vehicle system 200 during the trip based on time or location along the route. The throttle settings may be notch settings. In one embodiment, the throttle settings include eight notch settings, where Notch 1 is the low throttle setting and Notch 8 is the top throttle setting. Notch 8 corresponds to the upper power output limit, which is 12,000 horsepower in one embodiment. Thus, when the vehicle system 200 operates at Notch 8, the vehicle system 200 provides a power output at the upper power output limit (which is associated with the HPT of the vehicle system 200). During a trip, the trip plan may designate the vehicle system 200 to travel at Notch 5 along a first segment of the route, at Notch 7 along a second segment of the route, and at Notch 8 along a third segment of the route. As such, the vehicle system 200 is controlled to generate a power output that varies over time and/or distance along the route. The generated power output may be equal to the upper power output limit at some locations (e.g., along the third segment of the route) and lower than the upper power output limit at other locations (e.g., along the first and second segments).

In the pacing embodiment described in FIGS. 3 and 4, the trailing vehicle system 200 is configured to move automatically according to the leading vehicle system 300. Thus, the trailing vehicle system 200 alters the movements of the vehicle system 200 along the route 302 based on the movement and characteristics of the leading vehicle system 300, but the leading vehicle system 300 does not move based on the trailing vehicle system 200. For example, the trailing vehicle system 200 is configured to determine the HPT of the leading vehicle system 300. The trailing vehicle system 200 may determine the HPT of the leading vehicle system 300 based on a received message. The communication circuit 212 (shown in FIG. 2) may receive a wireless message from the leading vehicle system 200, from a dispatch location, or from another remote source that indicates that the HPT of the leading vehicle system 300 is 1.0. In an alternative embodiment, the identification and HPT of the leading vehicle system 300 may be stored in the memory 226 (shown in FIG. 2) of the vehicle system 200 prior to the trip. The trailing vehicle system 200 also receives status messages that indicate the location of the leading vehicle system 300. For example, the leading vehicle system 300 may transmit the current location of the leading vehicle system 300 to the trailing vehicle system 200 periodically (e.g., every 10 seconds, every 30 seconds, every minute, every 5 minutes, etc.) or responsive to receiving a request from the trailing vehicle system 200. The leading vehicle system 300 may transmit the updated location of the leading vehicle system 300 wirelessly or conductively along a catenary wire or a conductive track of the route 302. Optionally, a dispatch or another off-board source may communicate the updated location of the leading vehicle system 300 to the trailing vehicle system 200, either periodically or upon each request. In another example, the trailing vehicle system 200 may dispatch an aerial device (not shown), such as a drone, that is configured to fly remotely from the vehicle system 200 to the leading vehicle system 300 in order to monitor the location of the leading vehicle system 300.

FIG. 4 shows the effective HPT of the trailing vehicle system 200 over time. The "effective" HPT, as used herein, is a power-to-weight ratio that represents a "permitted" power output per weight limit for the trailing vehicle system 200. The permitted power output per weight limit is a selected or designated limit that may be equal to or less than the maximum achievable power output per weight that is based on the capabilities of the vehicle system 200. Thus, although the vehicle system 200 may be capable of providing 12,000 horsepower at the top throttle setting, the permitted power output per weight limit may restrict the vehicle system 200 to generating only power outputs that are lower than 12,000 horsepower, such as by limiting the throttle settings to avoid at least the top throttle setting. When the permitted power output per weight limit is less than the maximum achievable power output per weight, the acceleration and/or speed of the vehicle system 200 is restricted or limited as the vehicle system 200 travels along the route. The HPT values plotted in the graph 400 represent upper limits (e.g., constraints) and not actual power outputs provided by the vehicle system 200.

As shown in the graph 400, the trailing vehicle system 200 travels along the route 302 according to an effective HPT of 2.5 between times T1 and T2. Thus, the trailing vehicle system 200 can generate power outputs up to, but not exceeding, 2.5 times the weight of the trailing vehicle system 200. Although the effective HPT based on the permitted power output per weight limit is 2.5 between times T1 and T2, the actual power output generated during at least a portion of the period may be less than the permitted power output per weight limit. As shown in FIG. 3, the trailing distance 306 between the two vehicle systems 200, 300 decreases from time T1 to time T2. The reduced trailing distance 306 is attributable to the trailing vehicle system 200 traveling faster than the leading vehicle system 300 due to a greater effective HPT than the leading vehicle system 300, which has an HPT value of 1.0 (representing the maximum achievable power output per weight). The trailing vehicle system 200 is able to determine the trailing distance 306 based on the known location of the trailing vehicle system 200 (e.g., using the locator device 216 shown in FIG. 2) and the location of the leading vehicle system 300 as received in a message from the leading vehicle system 300, a dispatch location, an aerial device, or the like.

Between times T2 and T3, the trailing vehicle system 200 continues to make up ground on the leading vehicle system 300. At time T3, the trailing vehicle system 200 crosses a first proximity threshold 308 relative to the leading vehicle system 300. The first proximity threshold 308 is disposed rearward from a rear end 310 of the leading vehicle system 300. The first proximity threshold 308 is located a first proximity distance from the leading vehicle system 300. In an embodiment, the trailing vehicle system 200 crosses the proximity threshold 308 upon a front end 312 of the vehicle system 200 extending beyond the threshold 308. Alternatively, the trailing vehicle system 200 crosses the proximity threshold 308 upon a rear end 318 of the vehicle system 200 or a designated vehicle in the vehicle system 200 extending beyond the threshold 308. The trailing vehicle system 200 is able to determine when the front end 312 crosses the proximity threshold 308 when the calculated trailing distance 306 is less than the first proximity distance between the proximity threshold 308 and the leading vehicle system 300. The first proximity distance may be a known, static parameter that is stored in the memory 226 of the trip planning controller 206 or received by the trailing vehicle system 200 via the communication circuit 212. Alternatively, the location of the proximity threshold 308 relative to the leading vehicle system 300 may be adjusted based on the speed of the leading vehicle system 300 and/or the speed of the trailing vehicle system 200. For example, the proximity threshold 308 may be located farther from the leading vehicle system 300 as the speed of the leading vehicle system 300 and/or the trailing vehicle system 200 increases, due to a greater stopping distance that is necessary at higher speeds.

The first proximity distance relative to the leading vehicle system 300 is greater than an automatic slowdown range 314 that extends rearward from the leading vehicle system 300. If the trailing vehicle system 200 enters the automatic slowdown range 314, the trailing vehicle system 200 is required to immediately slow to a stop or a non-zero low speed in order to avoid an accident. The trailing vehicle system 200 is configured to cross the first proximity threshold 308 prior to entering the automatic slowdown range 314. Thus, by selectively limiting the power output of the trailing vehicle system 200 based on the HPT of the leading vehicle system 300 upon crossing the proximity threshold 308, the trailing vehicle system 200 is configured to avoid entering the automatic slowdown range 314.

The first proximity distance between the first proximity threshold 308 and the leading vehicle system 300 optionally may be calculated as a sum of a safe braking distance, a response time distance, and a safety margin distance. The safe braking distance represents the distance along the path of the route that the trailing vehicle system 200 would move before stopping in response to engagement of one or more brakes of the vehicle system 200. For example, if the trailing vehicle system 200 were to engage air brakes, the safe braking distance represents how far the trailing vehicle system 200 would continue to move subsequent to engaging the brakes before stopping all movement. The response time distance represents the distance along the path of the route that the trailing vehicle system 200 would travel before an operator onboard the trailing vehicle system 200 could engage the brakes in response to identifying an event that would cause application of the brakes, such as an obstacle on the route and/or damage to the route. The safety margin distance is additional distance along the route intended for safety. Thus, if the actual response time distance before applying the brakes is greater than the anticipated response time distance, the safety margin is able to accommodate the extra distance that the trailing vehicle system 200 would travel before stopping without resulting in an accident between the trailing vehicle system 200 and the leading vehicle system 300. Alternatively, the location of the proximity threshold 308 may be a function of an installed signaling system (e.g., a function of block size) or a function of other relevant locations. For example, the first proximity distance may be the distance of a single block or two blocks along the path of the route.

In response to crossing the proximity threshold 308, the trip planning controller 206 (shown in FIG. 2) is configured to set or designate a permitted power output per weight limit for the trailing vehicle system 200 that is less than the maximum achievable power output per weight (that is achievable based at least in part on the hardware of the vehicle system 200). The trailing vehicle system 200 crosses the proximity threshold 308 when the trailing distance is less than the first proximity distance relative to the leading vehicle system 300. Thus, if the maximum achievable power output of the trailing vehicle system 200 is 12,000 horsepower, the permitted power output per weight limit may restrict the trailing vehicle system 200 to generate no more than 8,000 horsepower. The permitted power output per weight limit may be enforced or implemented by limiting the throttle settings used to control the movement of the vehicle system 200 along the route. For example, because the top throttle setting is associated with the maximum achievable power output, the permitted power output per weight limit may restrict (e.g., prevent) the use of at least the top throttle setting, and potentially multiple throttle settings at the top range of the available throttle settings.

In an embodiment, the permitted power output per weight limit is set to be no greater than the power-to-weight ratio (e.g., maximum achievable power output per weight) of the leading vehicle system 300. Thus, the permitted power output per weight limit of the vehicle system 200 is less than or equal to the power-to-weight ratio of the leading vehicle system 300. Upon setting the permitted power output per weight limit, the trip planning controller 206 controls the movement of the trailing vehicle system 200 according to the permitted power output per weight limit, such that the power outputs generated by the vehicle system 200 do not exceed the permitted power output per weight limit.

At time T3, the trailing vehicle system 200 sets the permitted power output per weight limit to be less than or equal to the HPT of the leading vehicle system 300. Since the HPT of the leading vehicle system 300 is 1.0, the trailing vehicle system 200 limits the permitted power outputs to a range that does not exceed a resulting HPT of 1.0 for the trailing vehicle system 200. For example, throttle setting Notch 3 may generate a power output (e.g., 3840 horsepower) that provides an HPT of 0.8 and throttle setting Notch 4 may generate a power output (e.g., 5760 horsepower) that provides an HPT of 1.2. Therefore, since setting Notch 4 as the upper permitted limit would exceed the power-to-weight ratio (e.g., 1.0) of the leading vehicle 300, the Notch 3 throttle setting is the highest throttle setting that is less than the power-to-weight ratio of the leading vehicle system 300. As a result, the trip planning controller 206 is configured to set a permitted power output limit to 3840 horsepower and/or Notch 3. As the trailing vehicle system 300 continues to move along the route, the trip planning controller 206 limits the usable throttle settings to Notch 1, Notch 2, and Notch 3 for controlling the vehicle system 300. As shown in FIG. 4, the effective HPT at time T3 drops from 2.5 to 0.8, based on the adjustment to the permitted power output per weight limit.

From times T3 to T5, as shown in FIGS. 3 and 4, the trailing vehicle system 200 travels along the route 302 with an effective HPT of 0.8. Since the leading vehicle system 300 travels at an HPT of 1.0 that is greater than the current HPT of the trailing vehicle system 200, the leading vehicle system 300 may travel at an average speed from times T3 to T5 that is greater than the average speed of the trailing vehicle system 200, and the trailing distance 306 may gradually increase.

Optionally, the trip planning controller 206 of the trailing vehicle system 200 demarcates a second proximity threshold 316 relative to the leading vehicle system 300. The second proximity threshold 316 is located a second proximity distance from the leading vehicle system 300. The second proximity distance is greater than the first proximity distance between the vehicle system 300 and the first proximity threshold 308. The first proximity threshold 308 is referred to herein as a near threshold 308, and the second proximity threshold 316 is referred to herein as a far threshold 316. In an embodiment, as the trailing vehicle system 200 travels along the route 302 with the upper permitted power output limit that is associated with an HPT of 0.8 and the trailing distance 306 relative to the leading vehicle system 300 increases, eventually the trailing vehicle system 200 crosses the far threshold 316 such that a portion of the vehicle system 200 is farther from the leading vehicle system 300 than the far threshold 316. Although FIG. 3 depicts a rear end 318 of the trailing vehicle system 200 crossing the far threshold 316, in an alternative embodiment the far threshold 316 may be effectively crossed upon the front end 312 or another portion of the trailing vehicle system 200 extending beyond the far threshold 316.

In response to the trailing vehicle system 200 crossing the far threshold 316, the trip planning controller 206 of the trailing vehicle system 200 is configured to increase the permitted power output per weight limit of the vehicle system 200 such that the effective HPT is greater than the HPT of the leading vehicle system 300. For example, the trip planning controller 206 may increase the top permitted throttle setting to Notch 4, which is associated with an HPT of 1.2. Optionally, the top permitted throttle setting may be increased even higher, such as to Notch 5, Notch 6, Notch 7, or Notch 8. Thus, in one embodiment the trip planning controller 206 may increase the top permitted throttle setting such that the resulting effective HPT is slightly greater than the HPT of the leading vehicle system 300. But, in an alternative embodiment, the trip planning controller 206 may increase the effective HPT of the trailing vehicle system 200 to the attainable HPT of 2.5. Still, upon the trailing vehicle system 200 crossing the near threshold 308, the trip planning controller 206 is configured to lower the permitted power output per weight limit once again such that the effective HPT is lower than or equal to the HPT of the leading vehicle system 300.

As shown in FIG. 4, from times T5 to T6 the trailing vehicle system 200 travels at a permitted power output per weight limit that corresponds to an HPT of 1.2. Since the effective HPT of the trailing vehicle system 200 is once again greater than the HPT of the leading vehicle system 300 (e.g., at 1.0), the trailing vehicle system 200 may begin to reduce the trailing distance 306. The distance between the near threshold 308 and the far threshold 316 is a pacing range 320. The pacing range 320 is the area relative to the leading vehicle system 300 that the trailing vehicle system 200 is controlled to generally stay within in order to keep pace with the leading vehicle system 300. Although not shown in FIG. 3, eventually the trailing vehicle system 200 traveling according to an HPT of 1.2 will reduce the trailing distance 306 to a degree that the trailing vehicle system 200 crosses the near threshold 308 again. As shown in FIG. 4, the trailing vehicle system 200 crosses the near threshold 308 at time T7, and, in response, the trip planning controller 206 reduces the permitted power output per weight limit such that the effective HPT based on the permitted power output per weight limit is no greater than the HPT (e.g., the maximum achievable power output per weight) of the leading vehicle system 300. Thus, the trailing vehicle system 200 sets the HPT to 0.8 again, and the trailing vehicle system 200 travels between times T7 and T8 with a top permitted throttle setting that is associated with the HPT of 0.8 (e.g., Notch 3). Thus, the trailing vehicle system 200 may travel within the pacing range 320 of the leading vehicle system 300 by adjusting the power output constraints of the leading vehicle system 300 based on the relative location of the trailing vehicle system 200 to the near and far proximity thresholds 308, 316.

Figure 5:
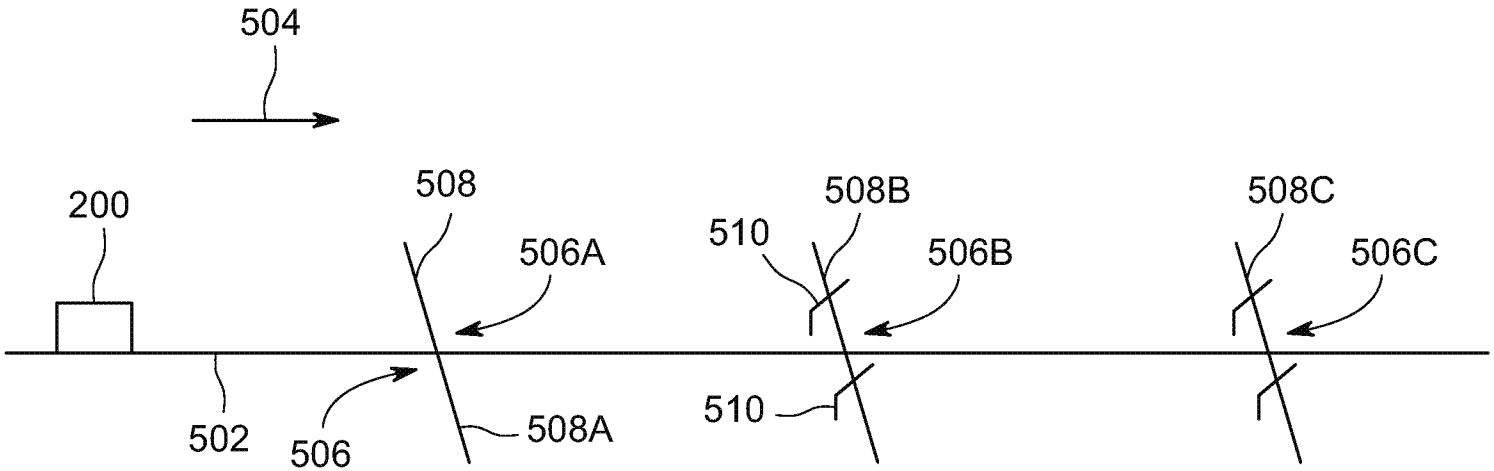
FIG. 5 is a schematic diagram of a vehicle system traveling along a route that includes multiple crossings according to an embodiment.

FIG. 5 is a schematic diagram of a vehicle system 200 traveling along a route 502 that includes multiple crossings 506 according to an embodiment. The vehicle system 200 may be the vehicle system 200 shown in FIG. 2. The vehicle system 200 travels along the route 502 in a direction 504 towards the crossings 506. Each crossing 506 corresponds to intersection of the first route 502 with an intersecting route 508. The first route 502, for example, may be configured as a railroad track over which a rail vehicle may travel. The intersecting route 508 at each crossing 506 may be a road or highway that is paved, leveled, or otherwise configured for automobile and/or truck travel. The crossings 506 may be considered as grade crossings in which the intersecting route 508 is at the grade of the first route 502.

The trip planning controller 206 (shown in FIG. 2) of the vehicle system 200 is configured to provide an automatic audible warning as the vehicle system 200 approaches one or more of the crossings 506. Thus, the trip planning controller 206 controls the operation of the audible warning without the need for operator input. Although operator input may not be required, the vehicle system 200 may not override the ability of the operator to actuate the audible warning, which may be accomplished via the manual input device 210 (shown in FIG. 2). Thus, the trip planning controller 206 may actuate the audible warning unless the operator manually actuates the audible warning in the same time period.

In an embodiment, the locations of the crossings 506 along the route 502 are able to be retrieved and/or received by the trip planning controller 206. For example, the locations may be retrieved from a database in the memory 226 (shown in FIG. 2) of the trip planning controller 206 in which the location information is stored. The crossings 506 may be mapped in order to provide the geographical coordinates of each crossing 506. As an alternative to retrieving the location information from a database, the information may be received from a remote source, such as from a wayside device that the vehicle system 200 passes along the route 502, another vehicle system, or a dispatch location. The location information may be transmitted in a message format from the remote source to the vehicle system 200.

In addition to the location information, additional information associated with each crossing 506 may also be stored in the memory 226 or received from a remote source. The additional information may include whether the corresponding crossing 506 is private or public, whether the crossing 506 is marked or unmarked, and whether there are any restrictions or rules associated with the crossing 506. A private crossing is privately owned, such as a dirt road on a farm that crosses the route 502. A public crossing is publicly owned, such as a public paved street or highway. Marked crossings include signs, indicator lights, crossing gates, and/or the like, to warn people and animals when a vehicle system is approaching the crossing, and unmarked crossings may not include such items. For example, private crossings may be unmarked or marked crossings. Public crossings are typically all marked crossings.

The restrictions and/or rules may include noise level restrictions based on time of day, location (e.g., work zones, quiet zones), and/or the like. For example, a specific crossing may be located in a quiet zone in which vehicles traveling along the route 502 are instructed not to actuate an audible warning as the vehicle approaches the crossing during night hours, such as between 10 P.M. and 6 A.M. In another example, the vehicle may be allowed to actuate an audible warning as the vehicle approaches the specific crossing at a given time of day, but the noise level of the audible warning is restricted to be less than a designated threshold noise level, such as 100 decibels (dB), 80 dB, 50 dB, or the like. Optionally, the restrictions and/or rules may include speed restrictions and/or emissions restrictions through the crossings in addition to noise restrictions. Therefore, as the vehicle system 200 travels along the route 502, the locations of and identifying information about each crossing 506 may be known and stored in a database of the vehicle system 200. Optionally, the vehicle system 200 may be configured to receive updated information about the crossings 506 as the vehicle system 200 moves along the route 502, such as by the communication circuit 212 receiving status messages that update noise level restrictions for one or more of the upcoming crossings 506. The update information can come from a centralized source (e.g., a dispatch center) or from devices installed at or near the crossings.

As the vehicle system 200 travels towards the crossings 506, the trip planning controller 206 monitors the current location of the vehicle system 200 relative to the crossings 506 and the current time of day. The trip planning controller 306 monitors the current location of the vehicle system 200 via the locator device 216 (shown in FIG. 2) and monitors the current time of day via the clock 228 (FIG. 2). The controller 206 (using the one or more processors 224 thereof) is able to determine the proximity of the vehicle system 200 to each of the crossings 506 as the vehicle system 200 moves along the route 502 based on the stored locations of the crossings 506 and the monitored location of the vehicle system 200. The controller 306 further monitors the speed of the vehicle system 200 via the speed sensor 218 (shown in FIG. 2).

As shown in FIG. 5, the vehicle system 200 first approaches a first crossing 506A. The intersecting route 508 at the first crossing 506A is a first intersecting route 508A. The first crossing 506A in the illustrated embodiment is a private crossing, and the route 508A may be a private dirt, stone, or paved road. In an embodiment, the trip planning controller 206 uses the stored database to identify the upcoming crossing 506A as a private crossing that does not require an audible warning. For example, since the intersecting route 508A has very little traffic, there is little risk of a person being present on the route 508A as the vehicle system 200 traverses through the crossing 506A. Thus, the trip planning controller 206 does not actuate the audible warning emitter 214 (shown in FIG. 2) as the vehicle system 200 traverses the first crossing 506A.

As the vehicle system 200 travels between the first crossing 506A and a second crossing 506B along the route 502, the trip planning controller 206 identifies the upcoming second crossing 506B in the database that is stored in the memory 226 based on the location of the vehicle system 200 relative to the stored location of the second crossing 506B. Upon identifying the crossing 506B, the trip planning controller 206 consults the database to determine the type of crossing and whether any noise restrictions are present, and also determines the proximity of the vehicle system 200 to the crossing 506B. In the illustrated embodiment, the second crossing 506B is a public crossing that includes markings, such as crossing gates 510. Although such a public crossing would typically necessitate an audible warning, the second crossing is associated with a time-of-day noise restriction that prohibits the sounding of any warning between the hours of 9 P.M. and 7 A.M. each day. The trip planning controller 206 determines, via the clock 228, that the current time is 4 A.M. and so the vehicle system 200 will travel through the crossing 506B within the restricted time period. Therefore, the controller 206 determines that the audible warning emitter will not be actuated as the vehicle system 200 approaches and passes through the second crossing 506B.

The vehicle system 200 next approaches a third crossing 506C after traversing the second crossing 506B. Based on the information stored in the database on the vehicle system 200 and the determined current location of the vehicle system 200, the trip planning controller 206 identifies the third crossing 506C as a public, marked crossing. The third crossing 506C is near residential housing, for example, and there is a noise restriction associated with the third crossing 506C that limits the noise level of audible warnings to be no greater than 100 dB. Therefore, the trip planning controller 206 may prepare to actuate the audible emitter 214 at a level that produces a warning no greater than 100 dB. The controller 206 continues to monitor the proximity of the vehicle system 200 to the third crossing 506C and the speed of the vehicle system 200 as the vehicle system 200 approaches the crossing 506C. The controller 206 determines when to actuate the emitter 214 based on the speed and proximity to the crossing 506C. For example, a regulation may direct the audible warning to consist of a sequence of two long pulses, one short pulse, and one long pulse at the end, such that the long pulse occurs as the front of the vehicle system 200 passes through the corresponding crossing. The entire sequence may take a given time period, such as 15 seconds. Therefore, based on the speed of the vehicle system and the known time period for the sequence of warning sounds, the trip planning controller 206 determines the distance from the crossing 506C at which to initiate the sequence of warning sounds. For example, if the vehicle system 200 travels at a constant speed of 60 mph and the time period for the sequence of warning sounds is 15 sec, then the trip planning controller 206 determines that the sequence should be initiated when the front of the vehicle system 200 is 0.25 miles from the crossing 506C (e.g., distance=speed*time). The trip planning controller 206 continues to monitor the location of the vehicle system 200 relative to the crossing 506C, and actuates the audible warning emitter 214 to generate the warning sequence (at a noise level of less than 100 dB) responsive to the front of the vehicle system 200 crossing the quarter mile proximity threshold.

One or more technical effects of the automatic warning system described above is a reduced operational load on the operator of the vehicle system and more consistent and accurate warning activations due to reduced human involvement.

In one or more embodiments, the display device 208 (shown in FIG. 2) of the vehicle system 200 is configured to automatically display information to an operator of the vehicle system 200 regarding upcoming route aspects, such as crossings, signals, and the like. For example, as the vehicle system 200 approaches a crossing (e.g., one of the crossings 506 shown in FIG. 5), the trip planning controller 206 may be configured to display on the display device 208 a countdown in terms of distance and/or time until the vehicle system 200 reaches the crossing. For example, the countdown may be displayed adjacent to an icon or symbol for a crossing as a successive series of distances, such as 1 mi ahead, 0.5 mi ahead, 0.25 mi ahead, and the like. The countdown is determined based on the known location of the crossing, the speed of the vehicle system 200, and the location of the vehicle system 200. The trip planning controller 206 may also display information about the crossing, such as whether the controller 206 will actuate the audible warning emitter 214 (shown in FIG. 2) for this crossing. For example, the controller 206 may display an indicator to an operator that identifies the upcoming crossing as being associated with a quiet order that restricts audible warnings. The display device 208 may provide a text-based signal that states, for example, "Quiet zone; Horn not activated." Thus, the operator viewing the display device 208 is notified that the audible warning emitter 214 should not be actuated upon approaching the upcoming crossing.

In an embodiment, the display device 208 of the vehicle system 200 may also be configured to display information about wayside signal aspects, such as crossing signals, block signals, and the like. The trip planning controller 206 may be configured to display both proximity information, such as a countdown in terms of distance and/or time, of an upcoming signal aspect as well as additional information identifying and describing the signal aspect. For example, an upcoming signal aspect may be a block signal that provides an indicator of whether another vehicle is ahead along the route in one of the next few blocks, such as one of the next two blocks. The route may be electrically segmented to form multiple blocks arranged side-by-side along a length of the route. If a vehicle system is approaching a block in which another vehicle is currently occupying, a block signal may be configured to notify the approaching vehicle system to slow to a stop in order to avoid an accident. Similarly, if the vehicle system approaches a first block and another vehicle is currently occupying a second block next to and beyond the first block, the block signal may notify the approaching vehicle system to slow to a designated lower speed and/or to be prepared to stop. Some block signals may provide an "all clear" signal if the upcoming few blocks are unoccupied, a "stop" signal if the upcoming block is occupied, and an "approach" signal if the first upcoming block is unoccupied but the second upcoming block is occupied. Optionally, the "all clear" signal aspect may be represented by a green over red indication on the block signal, the "stop" signal may be represented by two red lights, and the "approach" signal may be represented by a yellow over red indication.

In an embodiment, the trip planning controller 206 is configured to store location information and identification information about the signal aspects in a database within the memory 224. The identification information may include a type of signal (e.g., crossing signal or block signal), a part number of the signal, a physical layout of the signal, and the like. For example, the trip planning controller 206 may store a graphical image that corresponds to the actual signal device. Thus, as the vehicle system 200 approaches the signal aspect, the trip planning controller 206 identifies the upcoming signal and displays the graphical image on the display device 208. Furthermore, the trip planning controller 206 receives a status of the signal, such as whether a given block signal is providing an "all clear" signal, an "approach" signal, or a "stop" signal aspect. The trip planning controller 206 receives the status of the signal via a message from a wayside device (e.g., the signaling device), a dispatch location, another vehicle, an aerial device ahead of the vehicle system 200, or the like. The trip planning controller 206 is configured to receive the status of the signal before the status is within eyesight of the operator, due to the distance or obstacles between the signal and the vehicle system 200. In an embodiment, upon receiving the status of the signal device, the trip planning controller 206 is configured to display the status on the display device 208 as an indicator for viewing by the operator. The indicator may be presented on the graphical image of the signal device. For example, if the status is an "all clear" signal, the controller 206 may display a green light in an appropriate location on the graphical image of the signal device. Optionally, if the status is an "approach" signal or a "stop" signal aspect, the trip planning controller 206 may take further actions in addition to displaying the corresponding graphics on the display device 208. For example, the trip planning controller 206 may also actuate an audible, visual, and/or tactile (e.g., vibrating) alert for the operator. The trip planning controller 206 optionally may automatically slow the vehicle system 200 or at least instruct the operator to manually slow the vehicle system 200. The trip planning controller 206 also may automatically send a message to an off-board location, such as to a dispatch location or to one or more surrounding vehicles. One or more technical effects of the display system described above is to allow the operator to have advanced knowledge of the information prior to the vehicle system traveling within eyesight distance of a route aspect, such as a block signal or a crossing signal.

In an embodiment, the trip planning controller 206 is configured to update a generated trip plan during a trip of the vehicle system 200 along a route based on an order received via a positive train control (PTC) network. The PTC network may provide location-based orders for vehicles traveling through designated locations. The orders may be based on a rule or requirement of operation for a particular route segment, such as a speed limit or the like. The orders received via the PTC network may override or interrupt a previously planned controlled activity (e.g., a control activity previously determined by the trip planning controller 206) and/or an operator-controlled activity. For example, upon receiving a slow order from the PTC network, the vehicle system 200 may be controlled to automatically slow to a designated speed posted in the slow order. The automatic braking may be controlled by the trip planning controller 206 and/or the vehicle controller 202 (shown in FIG. 2). The communication circuit 212 may be configured to receive the PTC orders. In an embodiment, information from an order received via the PTC network may be displayed on the display device to the operator of the vehicle system 200. The information may include the designated speed limit for a designated segment of the route. The operator may use the manual input device 210 to confirm the slow order. The trip planning controller 206 may be configured to generate an updated trip plan that incorporates the PTC order. For example, the trip planning controller 206 may re-plan the segment of the trip associated with the slow order and may incorporate the designated speed limit of the slow order as a constraint in the analysis.

In another embodiment, the trip planning controller 206 is configured to automatically control movement of the vehicle system 200 through a work zone (e.g., a maintenance of way (MOW) zone) based on operator-input. For example, as the vehicle system 200 approaches a work zone in which a crew may be actively working on the route, the operator and/or the trip planning controller 206 may receive a communication from the crew, such as from a foreman of the crew. The communication expresses how the vehicle system 200 should travel through the work zone for the safety of the crew. For example, the communication may indicate that the vehicle system 200 is allowed to travel through the work zone at full speed, at a designated lower speed, or is required to stop before entering the work zone. In one embodiment, the operator may receive the communication, such as through a phone, a handheld transceiver, or the like, and may convey the message to the trip planning controller 206 via the manual input device 210. Alternatively, the trip planning controller 206 receives the communication from the crew, such as via the communication circuit 212, and displays the information to the operator on the display device 208. The operator is then able to confirm and/or select a movement plan for the upcoming work zone using the manual input device 210. In response to receiving an operator selection, the trip planning device 206 is configured to modify the trip plan to incorporate the selection. For example, in response to receiving an operator selection of traveling through the work zone at no more than 20 mph, the trip planning controller 206 may re-plan the segment of the trip associated with the work zone and may incorporate the designated speed limit of 20 mph as a constraint in the re-planning analysis. Thus, the trip planning controller 206 may continue to control the movement of the vehicle system 200 as the vehicle system 200 traverses through the work zone.

Figure 6:
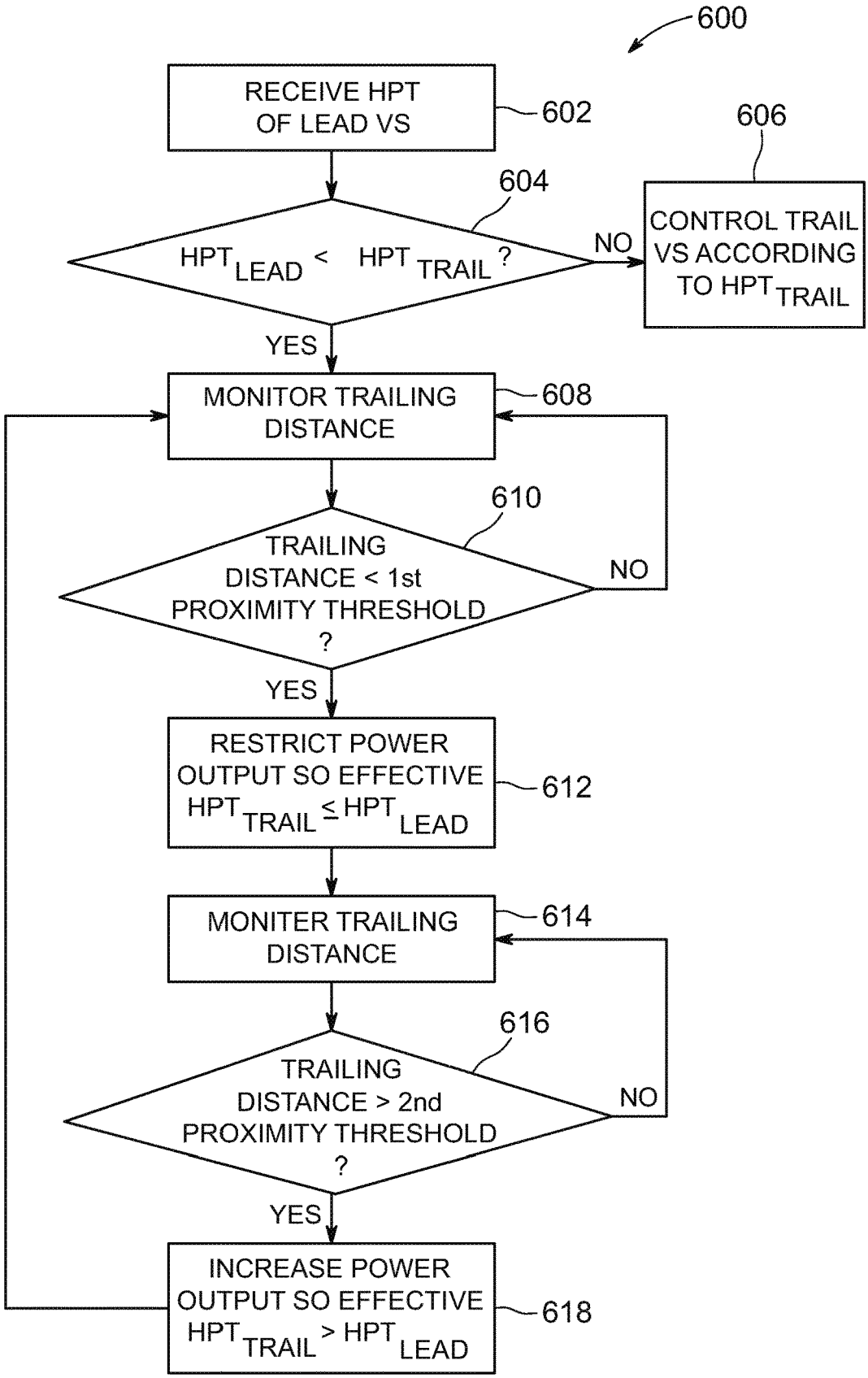
FIG. 6 is a flow chart of a method for controlling a vehicle system relative to another vehicle system ahead that is traveling along the same route in the same direction.

FIG. 6 is a flow chart of a method 600 for controlling a vehicle system relative to a vehicle system ahead traveling along the same route in the same direction. The vehicle system may be the vehicle system 200 shown in FIG. 2 and FIG. 3. The method 600 is configured to pace the movement of the vehicle system, referred to as a trailing vehicle system, based on the movement of a leading vehicle system ahead of the trailing vehicle system on the same route. The method 600 is configured to avoid the trailing vehicle system traveling too closely to the leading vehicle system, requiring the trailing vehicle system to stop and/or slow to considerably low speed for safety reasons. At 602, the trailing vehicle system receives a power-to-weight ratio of the leading vehicle system. The power-to-weight ratio represents the available power output of a vehicle system (to be used for propelling the vehicle system along the route) divided by the weight or mass of the vehicle system. In an embodiment, the power-to-weight ratio is represented as HPT, which stands for horsepower per tonnage. The HPT of the leading vehicle system may be received as a message communicated wirelessly, may be stored in a database onboard the trailing vehicle system, or the like. After the HPT of the leading vehicle system is received, the HPT of the leading vehicle system (shown in FIG. 6 as $HPT_{Lead}$) is compared to the HPT of the trailing vehicle system (shown in FIG. 6 as $HPT_{Trail}$).

At 604, a determination is made as to whether the HPT of the leading vehicle system is less than the HPT of the trailing vehicle system. If not, such that the HPT of the leading vehicle is equal to or greater than the HPT of the trailing vehicle, then flow of the method 600 proceeds to 606, and the trailing vehicle system is controlled along the route according to the HPT of the trailing vehicle system. Therefore, the trailing vehicle system is not controlled based on the leading vehicle system. If, on the other hand, the HPT of the leading vehicle is indeed less than the HPT of the trailing vehicle system, then flow proceeds to 608. At 608, a trailing distance between the leading vehicle system and the trailing vehicle system is monitored. The trailing distance may be monitored using a locator device on the trailing vehicle system to determine updated location information for the trailing vehicle system and a communication circuit that receives messages regarding the updated location of the leading vehicle system. Alternatively, the trailing distance may be monitored by consulting a trip plan being implemented by the leading vehicle system. For example, the trailing vehicle system may analyze the trip plan according to which the leading vehicle system is being controlled to determine an expected location of the leading vehicle system at a respective time. The trip plan implemented by the leading vehicle system optionally may be generated by the trailing vehicle system and communicated to the leading vehicle system.

At 610, a determination is made as to whether the trailing distance is less than a first proximity distance relative to the leading vehicle system. Thus, if the trailing vehicle system is closer to the leading vehicle system than a first proximity threshold that demarcates a distal end of the first proximity distance, then the determination is in the affirmative and flow of the method 600 proceeds to 612. But, if the trailing vehicle system is not closer to the leading vehicle system than the first proximity threshold, then the determination is negative, and flow returns to 608 for continued monitoring of the trailing distance.

At 612, the power output of the trailing vehicle system is restricted or limited such that an effective HPT of the trailing vehicle system is less than or equal to the HPT of the leading vehicle system. For example, the trailing vehicle system may limit the power output by restricting the throttle settings. Instead of using notch levels 1 through 8, the throttle settings may be limited such that only notch levels 1 through 5 are used. At the lower throttle settings, the power generated for propelling the vehicle system provides an effective power-to-weight ratio that is no greater than the available power-to-weight ratio of the leading vehicle system. At 614, the trailing distance between the leading and trailing vehicle systems is monitored, like at 608. At 616, a determination is made whether the trailing distance is greater than a second proximity distance. The second proximity distance is measured from the leading vehicle system and extends to a second proximity threshold at a distal end of the second proximity distance. The second proximity threshold is farther from the leading vehicle system than the first proximity threshold. If the trailing distance is greater than the second proximity distance, then at least a portion of the trailing vehicle system is farther from the leading vehicle system than the second proximity threshold, and flow continues to 618. If, on the other hand, the trailing distance is not greater than the second proximity distance, then the determination is negative and flow of the method 600 returns to 614 for continued monitoring of the trailing distance.

At 618, the power output of the trailing vehicle system is increased such that the effective HPT of the trailing vehicle system is greater than the HPT of the leading vehicle system. Therefore, instead of being restricted to using throttle settings of notch levels 1-5, the effective HPT is increased by allowing the use of notch level 6, notch levels 6 and 7, or all of the notch levels 6, 7, and 8. The throttle settings are used by the trip planning controller according to a trip plan in order to control the movement of the trailing vehicle system along the route. After 618, flow returns to 608 for continued monitoring of the trailing distance.

In one or more embodiments described herein, a single source may control the movement of a plurality of vehicle systems along a route by establishing permitted power output per weight limits and enforcing the permitted power output per weight limits on the vehicle systems as the vehicle systems travel along the route. Thus, instead of (or in addition to) each vehicle system being paced based on the movement of the vehicle system in front, the movements of multiple vehicle systems on the route may be controlled according to a single permitted power output per weight limit. The permitted power output per weight limit may be set by a source that is off-board the vehicle systems. For example, the source that sets the permitted power output per weight limit may be located at a dispatch or scheduling center, a wayside device, a crew change location, a station, a rail yard, or the like. The permitted power output weight limit may be set lower than the maximum achievable power output per weight of at least one (e.g., some) of the vehicle systems, such that the acceleration and/or speed capabilities of these vehicle systems may be limited or restricted by the enforcement of the permitted power output per weight limit.

Although setting the permitted power output per weight limit may lower the speeds achieved by one or more of the individual vehicle systems along the route, the implementation of the permitted power output per weight limit is configured to increase an overall vehicle throughput and efficiency along the route or some other system performance measure. For example, a technical effect of implementing a permitted power output per weight limit that is enforced against the vehicle systems traveling on the route is improved vehicle throughput along the route due to reduced variability in the movement of the vehicle systems. For example, it has generally been observed that vehicle throughput generally decreases with increased variation in the vehicle systems traveling on the route because such variation may cause an increase in braking events, starts and stops, meet-up and arrival delays, and the like, relative to the vehicle systems traveling with more uniform characteristics. For example, the throughput may increase when the vehicle systems travel according to the permitted power output per weight limit, even if the individual accelerations and/or speeds of at least some of the vehicle systems are reduced relative to traveling along the route without being constrained by the permitted power output per weight limit. In addition to improving network throughput along the route, the embodiments described herein may also reduce fuel consumption, reduce exhaust emissions, and/or reduce noise of the vehicle systems relative to not having an enforced permitted power output per weight limit.

It is recognized that power output per weight is related to acceleration capability. Although acceleration is related to speed, the permitted power output per weight limits described herein are separate and distinct from speed limits. For example, the route may have defined speed limits based on regulations. The permitted power output per weight limits described herein do not supersede applicable speed limits.

Figures 7, 8:
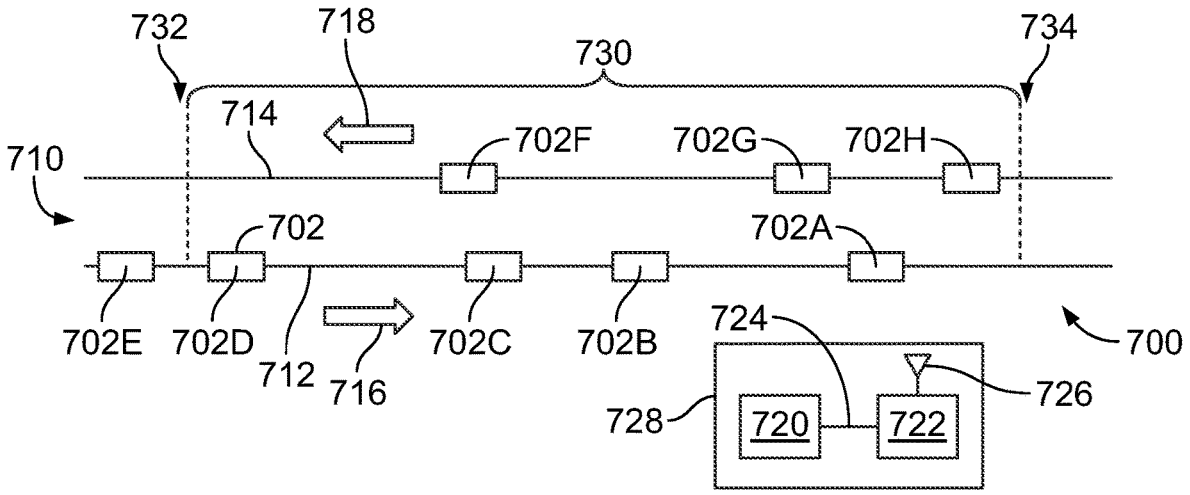
FIG. 7 a schematic diagram of a network control system that includes a plurality of vehicle systems scheduled to travel along a route according to an embodiment.
FIG. 8 is a table including a first column that lists vehicle systems scheduled to travel along the route, a second column that lists the maximum achievable power outputs per weight of the vehicle systems, and a third column that ranks the maximum achievable power outputs per weight based on magnitude.

FIG. 7 is a schematic diagram of a network control system 700 that includes a plurality of vehicle systems 702 scheduled to travel along a route 710 according to an embodiment. Each of the vehicle systems 702 may be similar to the vehicle system 200 shown in FIG. 2 and/or the vehicle system 102 shown in FIG. 1. For example, although each vehicle system 702 is depicted as a rectangle in FIG. 7, the rectangle may represent more than one vehicle operably coupled to each other to move together along the route 710. The route 710 includes a first path 712 and a second path 714. The vehicle systems 702 on the first path 712 move in a first direction of travel 716 (when the vehicle systems 702 are not stationary or temporarily backing up). The vehicle systems 702 on the second path 714 move in a second direction of travel 718 (unless stationary or temporarily backing up). The second direction of travel 718 is opposite the first direction 716.

In an embodiment, the vehicle systems 702 are rail vehicle systems, and the paths 712, 714 of the route 710 are railroad tracks. In an alternative embodiment, the vehicle systems 702 are road-based trucks and the paths 712, 714 represent different roads or different lanes of a common road, such as a highway. In yet another embodiment, the vehicle systems 702 may be off-road trucks, such as mining trucks, and the paths 712, 714 represent off-road courses.

While only two paths are illustrated for simplicity in FIG. 7, this is not limiting, and additional paths may exist going in either direction. For example, the route 710 may include at least three parallel paths (e.g., the two paths 712, 714 and at least one additional path), with some of the paths configured to permit vehicle travel in the first direction 716 and other of the paths configured to permit vehicle travel in the second direction 718. In a non-limiting example, the route 710 may be a paved highway, and the paths (e.g., 712, 714) are lanes of the highway. The highway may have one, two, three, four, or more lanes permitting vehicle traffic in each of the directions 716, 718. Furthermore, although only two directions 716, 718 of travel are shown in FIG. 7, the route 710 may permit vehicular travel in more than two directions, such that some of the paths of the route 710 may be transverse to other paths of the route 710 (instead of parallel).

The network control system 700 also includes a network controller 720 and a communication device 722. The network controller 720 is configured to set a permitted power output per weight (PO/W) limit for the vehicle systems 702 that are scheduled to travel along the route 710. The communication device 722 is operably connected to the network controller 720 via a wired or wireless communication link 724. The network controller 720 includes one or more processors and associated hardware circuits or circuitry, such as hardware logic-based devices. The one or more processors of the network controller 720 may operate based on programmed instructions (e.g., software) stored in a memory device accessible to the one or more processors. The memory device may be located within the network controller 720 or operably connected to the network controller 720. The communication device 722 may be the same or similar to the communication circuit 212 shown in FIG. 2. For example, the communication device 722 may include a transceiver (or a transmitter and discrete receiver), an antenna 726, and associated circuitry. Alternatively, the communication device 722 may be different from the communication circuit 212. For example, the communication device 722 may be a telephone, a two-way radio, a telegraph device, or the like. In another embodiment, the communication device 722 may include or represent a printer. For example, the desired PO/W limit could be printed by the communication device 722 on a piece of paper and carried to the vehicle by the operator, who manually enters the desired values via a user input device. In another embodiment, the communication device 722 may be non-electronic.

The network controller 720 is configured to communicate with the vehicle systems 702 via the communication device 722. For example, the network controller 720 may be configured to generate network messages that are wirelessly communicated to the vehicle systems 702 via the communication device 722. The network messages may designate limits and/or constraints, such as a permitted PO/W limit, for the vehicle systems 702 to abide by as the vehicle systems 702 travel along at least a segment of the route 710 within a predetermined time period. The network messages may also include speed limits and other information, such as traffic conditions, slow orders, the location of work zones, and the like. Optionally, the network messages may also include enforcement schedules with the permitted PO/W limit. The enforcement schedules prescribe one or more enforcement periods during which the vehicle systems 702 should enforce the permitted PO/W limit.

In the illustrated embodiment, the network controller 720 and the communication device 722 are offboard all of the vehicle systems 702 and are commonly located at an offboard location 728. The offboard location 728 may be a dispatch center or facility, a wayside device, a crew change station, a passenger or cargo station, or the like. In an alternative embodiment, the network controller 720 and the communication device 722 are disposed onboard one of the vehicle systems 702 that traverses the route 710.

The vehicle systems 702 are scheduled to travel along a segment 730 of the route 710 within a predetermined time period. The segment 730 is a length of the route 710 that extends between a first end 732 and a second end 734. The route 710 may extend beyond the first end 732 and/or the second end 734 outside of the segment 730. In a non-limiting example embodiment, the segment 730 may be a subdivision or block that has a predefined location. For example, the segment 730 may be a specific block of a series of blocks that define the route 710. The ends 732, 734 of the segment 730 may be based on the locations of stations, such as crew change stations or passenger stations. In a non-limiting example, the segment 730 extends from a first crew change station at the first end 732 to a second crew change station at the second end 734. The length of the segment 730 may be on the order of miles (kilometers). For example, the segment 730 may have a length that is between 50 miles (80 km) and 300 miles (482 km), which may represent the distance traveled during a crew shift.

Optionally, the network controller 720 may be configured to analyze the planned movement of additional vehicle systems besides the vehicle systems 702 scheduled to travel along the segment 730 of the route 710, such as vehicle systems scheduled to travel along routes nearby the illustrated route 710 during the predetermined time period. For example, the network controller 720 may analyze the planned movement of vehicle systems schedules to travel along a designated geographic area of a network of plural routes during the predetermined time period. The designated geographic area includes the segment 730 shown in FIG. 7 and additional segments of the same route 710 and/or different routes. One or more of the routes may intersect within the designated geographic area. The permitted PO/W limit may be enforced against vehicle systems scheduled to travel within the designated geographic area, even along different routes within the geographic area.

The predetermined time period may be a default duration of time or an amount of time that is selected by a human operator. In a non-limiting example, the predetermined time period may be a particular day (e.g., Wednesdays). Thus, the relevant vehicle systems 702 may be the vehicle systems 702 scheduled to travel along the segment 730 of the route 710 at any time throughout the length of a specific day. In other non-limiting examples, the predetermined time period may be a half day (e.g., daytime on Wednesdays) or other portion of a day, or alternatively may refer to length of time that represents multiple days, such as a week.

FIG. 7 shows eight vehicle systems 702 that are scheduled to travel along the segment 730 of the route 710 within the predetermined time period. The vehicle systems 702 are scheduled according to the respective schedules of the vehicle system 702 received from the off-board scheduling system. It is recognized that all or at least some of the vehicle systems 702 are scheduled to travel between different starting locations and ending locations. Thus, although the vehicle systems 702 shown in FIG. 7 travel along the same stretch of the route 710, the vehicle systems 702 may be different types of vehicle systems 702 having different propulsion capabilities (e.g., power-to-weight ratios) that travel from different starting locations and/or to different destinations for different purposes (e.g., freight transport, passenger transport, work vehicles, etc.), similar to the vehicles that traverse a highway during a period of time.

Five of the vehicle systems 702, including a first vehicle system 702A, a second vehicle system 702B, a third vehicle system 702C, a fourth vehicle system 702D, and a fifth vehicle system 702E, travel along the first path 712 in the first direction of travel 716. In the illustrated embodiment, the fifth vehicle system 702E is currently located outside of the segment 730, but will enter the segment 730 before the end of the predetermined time period (e.g., before the end of the day). Three of the vehicle systems 702, including a sixth vehicle system 702F, a seventh vehicle system 702G, and an eighth vehicle system 702H, travel along the second path 714 in the second direction of travel 718.

According to one or more embodiments, the network controller 720 is configured to set a permitted PO/W limit for the vehicle systems 702 that are scheduled to travel along the segment 730 of the route 710 during the predetermined time period. When the permitted PO/W limit is enforced, the vehicle systems 702 avoid generating power outputs that would cause the actual power output per weight of the vehicle systems 702 to exceed the permitted PO/W limit while the vehicle systems 702 travel through the segment 730. The permitted PO/W limit is a power-to-weight ratio, and can be represented by available vehicle horsepower per ton (HPT). The permitted PO/W limit is less than a maximum achievable power output per weight (PO/W) of at least some of the vehicle systems 702. Therefore, the enforcement of the permitted PO/W may restrict the acceleration (and associated speed) of one or more of the vehicle systems 702 by limiting the available throttle settings.

The network controller 720 may set the permitted PO/W limit based on various factors including a predetermined PO/W limit, one or more route characteristics of the route 710, and/or the maximum achievable PO/W of one or more of the vehicle systems 702. The permitted PO/W limit may be set by the network controller 720 using a calculation and/or a look-up table, analyzing received information and making a determination according to programmed instructions, or the like. Once the permitted PO/W limit is set, the network controller 720 may communicate the permitted PO/W limit to the relevant vehicle systems 702 using the communication device 726. For example, the network controller 720 may generate a network message that includes the permitted PO/W limit, and the communication device 726 may broadcast or transmit the network message to the vehicle systems 702.

In an embodiment, the network controller 720 may set the permitted PO/W limit based on a predetermined PO/W limit. The predetermined PO/W limit may be selected without consideration of the characteristics of the vehicle systems 702 or the characteristics of the route 710. For example, the predetermined PO/W limit may be selected by operator input, such as a dispatcher utilizing an input device. Alternatively, the predetermined PO/W limit may be accessed by the network controller 720 from a database in a memory storage device. The database may include historical information such as network throughput data associated with different predetermined PO/W limits recorded during test cases and/or prior operations. The historical information may include a look-up table that identifies different PO/W limits, different route segments, and/or different network throughput data resulting from the PO/W limits at the route segments. The network controller 720 may be programmed to select the PO/W limit in the look-up table will provide a predetermined network throughput (e.g., in number of vehicle systems over time) for the given segment 730 of the route 710. The predetermined network throughput may be set by an operator or programmed as a default value into the program instructions of the network controller 720. Once the predetermined PO/W limit is determined, the network controller 720 designates the predetermined PO/W limit as the permitted PO/W limit.

In an embodiment, the permitted PO/W limit may be specific to the vehicle systems 702 scheduled to travel in the same direction and/or on the same path along the route 710. The two paths 712, 714 along the route 710 are separate and discrete, so the movement of vehicle systems 702A-E along the first path 712 may not have any effect on the movement of the vehicle systems 702F-H along the second path 714, and vice-versa. The vehicle controller 720 may set a first permitted PO/W limit to control the movement of the vehicle systems 702A-E along the first path 712 traveling in the first direction 716, and may set a second permitted PO/W limit to control the movement of the vehicle systems 702F-H along the second path 714 traveling in the second direction 718. Optionally, the vehicle controller 720 may set a third permitted PO/W limit to control the movement of the vehicle systems scheduled to travel in the first direction 716 along a third path that is parallel to the first path 712. The first and third paths may be lanes of a common paved highway, adjacent railroad tracks, or the like. In a non-limiting example, the first path 712 may be designated as a high-occupancy vehicle (HOV) lane, and the third path is designated for general traffic.

When the permitted PO/W limits are set based on maximum achievable PO/W of the vehicle systems 702, the network controller 720 may only factor the maximum achievable PO/W of the specific vehicle systems 702 scheduled to travel on the particular paths and/or in the particular directions. For example, the first permitted PO/W limit for the first path 712 may be set based on the maximum achievable PO/W of each of the vehicle systems 702A-E independent of the maximum achievable PO/W of the vehicle systems 702F-H scheduled to travel on the second path 712 in the opposite direction. Conversely, the second permitted PO/W limit may be set based on the maximum achievable PO/W of each of the vehicle systems 702F-H independent of the maximum achievable PO/W of the vehicle systems 702A-E.

FIG. 8 is a table 800 including a first column 802 that lists the vehicle systems 702A-F scheduled to travel along the segment 730 of the route 710 in the first direction of travel 716 within the predetermined time period, a second column 804 that lists the maximum achievable PO/W of the vehicle systems 702A-F as HPT values, and a third column 806 that ranks the HPT values from highest to lowest based on magnitude. In the illustrated embodiment, the first vehicle system 702A has a HPT value of 2.0, the second vehicle system 702B has a HPT value of 3.0, the third vehicle system 702C has a HPT value of 2.5, the fourth vehicle system 702D has a HPT value of 1.5, and the fifth vehicle system 702E has a HPT value of 4.0. The network controller 720 may determine the maximum achievable PO/W (e.g., HPT value) of the specific vehicle systems 702A-E by accessing a database that contains such information or by requesting such information directly from the vehicle systems 702A-E or another source. For example, a dispatch facility that generates the schedules for at least some of the vehicle systems 702 may include a schedule database that includes vehicle-specific information including the maximum achievable PO/W about the vehicle systems 702. The network controller 720 may access the schedule database and/or send a request for information about the vehicle systems 702 to the dispatch facility.

According to one or more embodiments, once the maximum achievable PO/W of each of the vehicle systems 702A-E are determined, the network controller 720 is configured to set the permitted PO/W limit for vehicles 702 scheduled to travel along the path 712 in the first direction 716 based on the maximum achievable PO/W of these vehicle systems 702A-F. For example, the network controller 720 may rank the maximum achievable PO/W values of the vehicle systems 702A-F in order based on magnitude. The third column 806 of the table 800 shows that the fifth vehicle system 702E has the highest (or greatest) maximum achievable PO/W limit with an HPT of 4.0 and is ranked number 1. The fourth vehicle system 702D has the lowest maximum achievable PO/W limit with an HPT of 1.5 and is ranked number 5. The ranking in the third column 806 represents an ordered distribution of the maximum achievable PO/W values of the vehicle systems 702A-E.

The permitted PO/W limit for the vehicle systems 702A-E traveling on the path 712 may be set as a function based on the distribution. For example, in an embodiment, the network controller 720 is programmed to select the lowest maximum achievable PO/W in the distribution as the permitted PO/W limit. According to the table 800, the HPT of 1.5 is set as the permitted PO/W limit because 1.5 is the lowest HPT value. After setting the permitted PO/W limit, the network controller 720 may communicate the permitted PO/W limit to the vehicle systems 702A-E via the communication device 722. The vehicle systems 702A-E implement the permitted PO/W limit by not exceeding the permitted PO/W limit while the each of vehicle systems 702A-E travels through the segment 730 of the route 710. Therefore, once the first vehicle system 702A on the path 712 enters the segment 730 across the first end 732, the first vehicle system 702A restricts the throttle settings to prevent generating power outputs that would cause the first vehicle system 702A to exceed the HPT value of 1.5. Although the permitted PO/W limit is less than the maximum achievable PO/W of the vehicle systems 702A, 702B, 702C, and 702E, enforcing the permitted PO/W limit on the vehicle systems 702A-E as the vehicle systems 702A-E travel along the segment 730 of the route 710 may increase vehicle throughput along the segment 730 (relative to not enforcing the permitted PO/W limit on the vehicle systems 702A-E). For example, without the permitted PO/W limit, the fifth vehicle system 702E with a HPT value of 4.0 would quickly catch up to the fourth vehicle system 702D with the lower HPT of 1.5. The fifth vehicle system 702E may have to slow down considerably to avoid traveling too close to the fourth vehicle 702D. Over the length of the segment 730 multiple such starting and stopping events of the fifth vehicle system 702E may reduce the throughput of the route 710 by causing other vehicles behind the fifth vehicle system 702E to also slow.

In another embodiment, the network controller 720 is programmed to set the permitted PO/W limit based on the maximum achievable PO/W in the distribution that is closest to a pre-selected percentile. In a non-limiting example, the pre-selected percentile is the $25^{th}$ percentile. Because the distribution in FIG. 8 includes five HPT values, the fourth greatest HPT value (e.g., second lowest HPT value) represents the $20^{th}$ percentile which is closest to the pre-selected $25^{th}$ percentile. The first vehicle system 702A has the fourth greatest HPT value according to the ranking. Therefore, the network controller 720 may set the permitted PO/W limit based on the maximum achievable PO/W of the first vehicle system 702A. The first vehicle system 702A has a HPT value of 2.0, so the network controller 720 may set the permitted PO/W limit to be a HPT value of 2.0. In this embodiment, the permitted PO/W limit at a HPT value of 2.0 is greater than if the permitted PO/W limit is based on the lowest maximum achievable PO/W, which is a HPT value of 1.5. Therefore, except for the fourth vehicle system 702D that is limited in capability, all of the other vehicle systems 702A, 702B, 702C, 702E traveling in the first direction 716 through the segment 730 can generate power outputs that exceed an HPT value of 1.5 as long as the power outputs do not exceed an HPT value of 2.0. In an embodiment, if the fifth vehicle system 702E catches up to the fourth vehicle system 702D, such that the fifth vehicle system 702E crosses a first proximity threshold 308 (shown in FIG. 3) relative to the fourth vehicle system 702D, a trip planning controller (e.g., the trip planning controller 206 shown in FIG. 2) onboard the fifth vehicle system 702E may pace the fifth vehicle system 702E based on the power-to-weight ratio (e.g., a HPT of 1.5) of the fourth vehicle system 702D, as described above with reference to FIGS. 3 and 4, to prevent the fifth vehicle system 702E from traveling too close to the fourth vehicle system 702D and requiring a mandated stopping order. In another example, the crossing of the proximity threshold between the fourth and fifth vehicle systems 702D, 702E may be determined by an external signaling system that generates a block occupancy signal indicating that the block ahead of the fifth vehicle system 702E is occupied by the fourth vehicle system 702D.

Although the $25^{th}$ percentile is used in the example above, other embodiments may select the permitted PO/W limit based on different pre-selected percentiles, such as $30^{th}$ percentile, $40^{th}$ percentile, 50th percentile, or the like. Furthermore, instead of selecting the lowest maximum achievable PO/W as the permitted PO/W limit, in other embodiments the second-lowest maximum achievable PO/W, third-lowest, fourth-lowest, or the like may be set as the permitted PO/W limit. In general, a higher permitted PO/W limit enables greater acceleration and faster speeds of the vehicle systems 702 through the segment 730 of the route 710 relative to a lower permitted PO/W limit. The greater accelerations and speeds would not necessarily reduce overall travel times or throughput though, due to a greater likelihood of vehicle systems 702 catching up to other vehicle systems 702 and requiring mandated stops or slow orders to increase the distance between vehicle systems 702.

In another embodiment, the network controller 720 may set the permitted PO/W limit based on a calculation utilizing the maximum achievable PO/W values of the vehicle systems 702A-E. For example, the network controller 720 may calculate one or more statistical metrics based on the maximum achievable PO/W values of the relevant vehicle systems 702A-E. The statistical metrics may include mean, median, standard deviation, and/or the like. For example, the network controller 720 may be programmed to set the permitted PO/W limit as the median of the maximum achievable PO/W values. In the illustrated embodiment, the HPT of 2.5 is the median value, as it is in the middle of the distribution. Thus, the network controller 720 may set the permitted PO/W limit to be the HPT of 2.5. In another example, the network controller 720 may calculate the mean or average of the maximum achievable PO/W values and use the average value as the permitted PO/W limit. In the illustrated embodiment, the average of the five HPT values is 3.0, so the network controller 720 may set the permitted PO/W limit to be the HPT of 3.0. In other embodiments, the permitted PO/W limit may be generated according to other types of calculations utilizing the individual maximum achievable PO/W values of the vehicle systems 702A-E.

Although FIG. 8 is specifically directed to the vehicle systems 702A-E that travel on the path 712, the network controller 720 may set a different (e.g., second) permitted PO/W limit for the vehicle systems 702F-H scheduled to travel on the path 714 based on the maximum achievable PO/W values of the vehicle systems 702F-H. For example, the network controller 720 may designate the lowest HPT value as the permitted PO/W limit, select the HPT value closest to a pre-selected percentile, or calculate a median or average of the HPT values of the vehicle systems 702F-H. As described above, the network controller 720 may also set different permitted PO/W limits for other vehicle systems scheduled to travel on different paths along the segment 730 of the route 710 (in either direction 716, 718), such as different lanes in a multi-lane highway.

Figure 9:
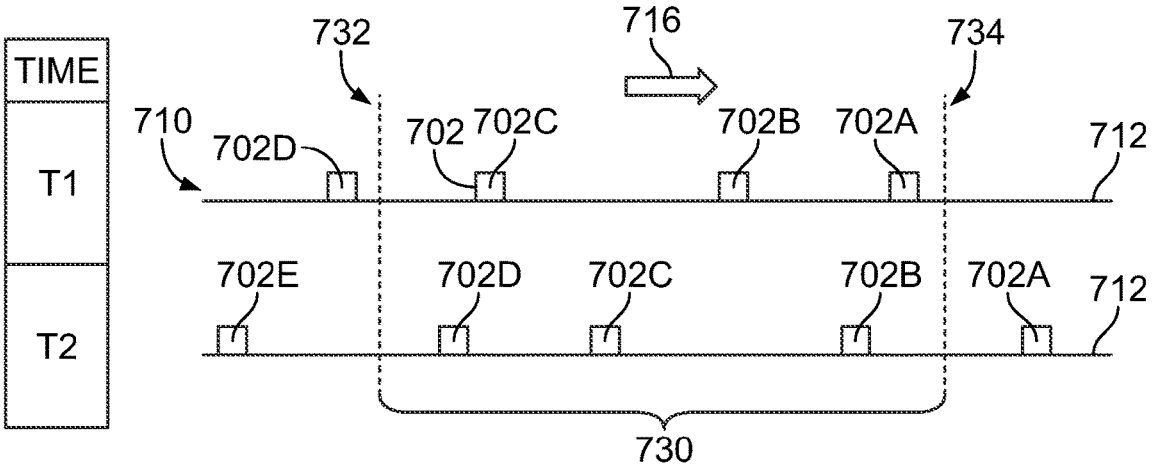
FIG. 9 is a schematic diagram showing the vehicle systems traveling along the route at two different times within a predetermined time period according to an embodiment.

FIG. 9 is a schematic diagram showing the vehicle systems 702A-E traveling along the route 710 at two different times within the predetermined time period according to an embodiment. The vehicle systems 702A-E travel along the first path 712 of the route 710 in the first direction of travel 716. At the first time (e.g., T1), only three vehicle systems 702A, 702B, and 702C are commonly located on the segment 730 of the route 710. For example, the fourth vehicle system 702D has not yet reached the first end 732 to enter the segment 730. At the second time (e.g., T2), which is subsequent to the first time, only vehicles 702B, 702C, and 702D are commonly located on the segment 730 of the route 710. The first vehicle system 702A has passed beyond the second end 734 to exit the segment 730, and the fifth vehicle system 702E has not yet reached the first end 732 to enter the segment 730.

According to one or more embodiments, the network controller 720 (shown in FIG. 7) is configured to dynamically update the permitted PO/W limit based on the specific vehicle systems 702 that are commonly located on the segment 730 of the route 710 at a given time. For example, the permitted PO/W limit is based on the maximum achievable PO/W value of each of the vehicle systems 702 scheduled to be located on the segment 730 at the same time. For example, the permitted PO/W limit that is enforceable at time T1 is based on the maximum achievable PO/W values of the vehicle systems 702A, 702B, 702C only because these are the vehicle systems commonly located on the segment 730 at time T1. The permitted PO/W limit that is enforced at time T1 may be independent of the maximum achievable PO/W values of the vehicle systems 702D and 702E that are scheduled to travel through the segment 730 at a later time.

The network controller 720 may update the permitted PO/W limit based on a change in the particular vehicle systems 102 located on the segment 730. For example, the network controller 720 may set an updated permitted PO/W limit once the network controller 720 determines, based on the schedules of the vehicle systems 702 or received messages, that the first vehicle system 702A has passed the second end 734 to exit the segment 730 and/or that the fourth vehicle system 702D has passed the first end 732 to enter the segment 730. The updated permitted PO/W limit is enforced on the vehicles 702B, 702C, 702D traveling through the segment 730 at the second time T2. The updated permitted PO/W limit may be based on the maximum achievable PO/W values of the vehicle systems 702B, 702C, 702D only because these are the vehicle systems 702 commonly located on the segment 730 at time T2.

In an embodiment, the network controller 720 is configured to set the updated permitted PO/W limit that will be enforced at time T2 to constrain the movement of the vehicle systems 702B, 702C, 702D commonly located on the segment 730 of the route 710 in advance. For example, the network controller 720 may be able to determine the locations of the vehicle systems 702A-E relative to the ends 732, 734 of the segment 730 at different times based on the known schedules of the vehicle systems 702A-E and/or from communications with the vehicle systems 702A-E and/or with a dispatch center. At or around time T1, the network controller 720 may be able to estimate the time at which the first vehicle system 702A will exit the segment 730 and/or the time at which the fourth vehicle system 702D will enter the segment 730. If the first vehicle system 702A exits around the same time as the fourth vehicle system 702D enters, the network controller 720 may assume that the two events occur at the same time and may set the updated permitted PO/W limit based on the maximum achievable PO/W values of the second, third, and fourth vehicle systems 702B, 702C, 702D. The network controller 720 may communicate the updated permitted PO/W limit to all of the vehicle systems 702A-E on the first path 712, or at least to the three vehicle systems 702B, 702C, 702D commonly located on the segment 730 at time T2, prior to the first vehicle system 702A exiting and/or the fourth vehicle system 702D entering. Therefore, as soon as the estimated time at which the first vehicle system 702A exits the segment 730 and the fourth vehicle system 702D enters the segment 730 occurs, the three vehicle systems 702B, 702C, 702D on the segment 730 can travel according to the updated permitted PO/W limit (instead of the original permitted PO/W limit). In an alternative embodiment, the network controller 720 may periodically update the permitted PO/W limit at a designated interval instead of waiting until a vehicle system enters or exits the segment 730.

In an embodiment, the permitted PO/W limit that is most current and up-to-date is enforced by the vehicle systems 702 while the vehicle systems 702 travel on the segment 730 of the route 710. For example, all of the vehicle systems 702A-E shown in FIG. 9 may enforce the most current permitted PO/W limit upon crossing the first end 732 to enter the segment 730. The vehicle systems 702 that are already on the segment 730 when an updated permitted PO/W limit is received from the network controller 720 may automatically enforce the updated permitted PO/W limit upon receipt of the updated permitted PO/W limit.

The permitted PO/W limit is enforced by the vehicle systems 702 as a function of time, distance, and/or location along the route 710. For example, as described above, the permitted PO/W limit may automatically be enforced against (e.g., applied to) the vehicle systems 702 upon the vehicle systems 702 that travel on a specific path and/or direction of travel entering the segment 730 of the route 710 and/or receiving a message identifying the permitted PO/W limit. Alternatively, the enforcement of the permitted PO/W limit may be postponed such that one or more of the vehicle systems 702 do not automatically implement the permitted PO/W limit upon receipt of or upon entering the segment 730. For example, the network controller 720 may generate an enforcement schedule that prescribes one or more enforcement periods during which the permitted PO/W limit is enforced by the vehicle systems 702. The enforcement schedule may be communicated to the vehicle systems 702 in the same message with the permitted PO/W limit or in different messages. The enforcement schedule may have different enforcement periods for different corresponding vehicle systems 702 such that the enforcement periods are vehicle-specific. The enforcement periods may be characterized by time, location along the route 710, distance traveled along the route 710, or path along the route. The network controller 720 may generate the enforcement schedule based on a priori information about the movement of the vehicle systems 702, such as speed limits, designated schedules for the vehicle systems 702, slow orders, and/or the like. The schedules for the vehicle systems 702 may indicate locations and times for planned stops. The network controller 720 may utilize the enforcement schedule to control when the vehicle systems 702 are constrained by the permitted PO/W limit. For example, the vehicle systems 702 may be permitted to exceed the permitted PO/W limit outside of the enforcement periods prescribed by the enforcement schedule. Based on the a priori information about the movement of the vehicle systems 702, the network controller 720 can estimate when a trailing vehicle system 702 may approach a vehicle system 702 ahead (referred to as a leading vehicle system), and can schedule an enforcement period at that time to constrain the movement of the trailing vehicle system 702 and prevent the trailing vehicle system 702 from traveling within a designated threshold distance of the leading vehicle system 702.

In an embodiment, the network controller 720 may generate the enforcement schedule to postpone enforcing the permitted PO/W limit on one or more of the vehicle systems 702 based on an amount of distance or headway between the respective vehicle system 702 and an adjacent vehicle system 702 on the same path 712 of the route 710. In the illustrated embodiment, prior to the fourth vehicle system 702D crossing the first end 732 to enter the segment 730, the network controller 720 may determine (e.g., estimate and/or calculate) an amount of headway between the fourth vehicle system 702D and the third vehicle system 702C in front of the fourth vehicle system 702D on the path 712 in the same direction of travel 716. In this example, the third vehicle system 702C is a leading vehicle system and the fourth vehicle system 702D is a trailing vehicle system that follows behind the leading vehicle system. There are no other vehicles on the path 712 between the leading vehicle system and the trailing vehicle system.

The network controller 720 may postpone enforcing the permitted PO/W limit on the trailing vehicle system 702D to allow the trailing vehicle system 702D to travel through at least a portion of the segment 730 unrestrained by a power output limit. While the permitted PO/W limit is postponed, the trailing vehicle system 702D may travel through the segment 730 limited only by regulatory constraints, such as speed limits, and inherent mechanical constraints, such as the maximum achievable PO/W of the trailing vehicle system 702D. Although the permitted PO/W limit may be postponed for the trailing vehicle system 702D, the permitted PO/W limit may be enforced against other vehicle systems 702 on the segment 730 of the route 710, such as the leading vehicle system 702C. The trailing vehicle system 702D may reduce the distance between the two vehicle systems 702C, 702D during the postponement because the power output of the leading vehicle system 702C may be limited by the PO/W limit.

The network controller 720 may postpone the enforcement of the permitted PO/W limit on the trailing vehicle system 702D based on the amount of headway of the leading vehicle system 702C. For example, the greater the headway or distance separating the vehicle systems, the less likely the trailing vehicle system 702D will catch up to the leading vehicle system 702C if the permitted PO/W limit is postponed against the trailing vehicle system 702C. Inversely, the shorter the distance separating the vehicle systems, the more likely the trailing vehicle system 702D will be able to catch up to the leading vehicle system 702C if the permitted PO/W limit is postponed. Therefore, the network controller 720 may determine an extent of the postponement, in terms of time or travel distance, based on the amount of headway of the leading vehicle system 702C. For example, the network controller 720 may postpone enforcement of the permitted PO/W limit on the trailing vehicle system 702D for a longer amount of time and/or a greater travel distance of the trailing vehicle system 702D through the segment 730 if the leading vehicle system 702C is thirty miles ahead than if the leading vehicle system 702C is fifteen miles ahead. The network controller 720 may also consider other factors, such as grade of the segment, the maximum achievable PO/W limit of the trailing vehicle system 702D, and/or the magnitude of the permitted PO/W limit when determining the extent of the postponement.

The network controller 720 may dictate the enforcement schedule to the vehicle systems 702 based on time, distance, and/or location along the route 710. For example, the enforcement schedule may indicate that the trailing vehicle system 702D does not need to implement the permitted PO/W limit until a designated amount of time has elapsed after the trailing vehicle system 702D enters the segment 730, until the trailing vehicle system 702D reaches a designated location along the segment 730 (e.g., a mile marker or the like), or until the trailing vehicle system 702D travels a designated distance along the segment 730. After the designated time elapses, the designated location is reached, and/or the designated distance is traveled, the trailing vehicle system 702D is configured to implement the permitted PO/W limit while traveling through the remainder of the segment 730, or until the enforcement period ends.

In another embodiment, the permitted PO/W limit may be postponed indefinitely until a trailing vehicle system 702 catches up to a leading vehicle system 702 on the same path moving in the same direction. For example, the trailing vehicle system 702 may travel unrestrained by the permitted PO/W limit until the trailing vehicle system 702 is determined to be within a designated threshold proximity of the leading vehicle system 702 or until the trailing vehicle system 702 encounters a block occupancy signal from an external signaling system that indicates that the block is currently occupied by the leading vehicle system 702. In response, the trailing vehicle system 702 enforces the permitted PO/W limit to avoid narrowing the distance between the two vehicle systems 702.

Figure 10:
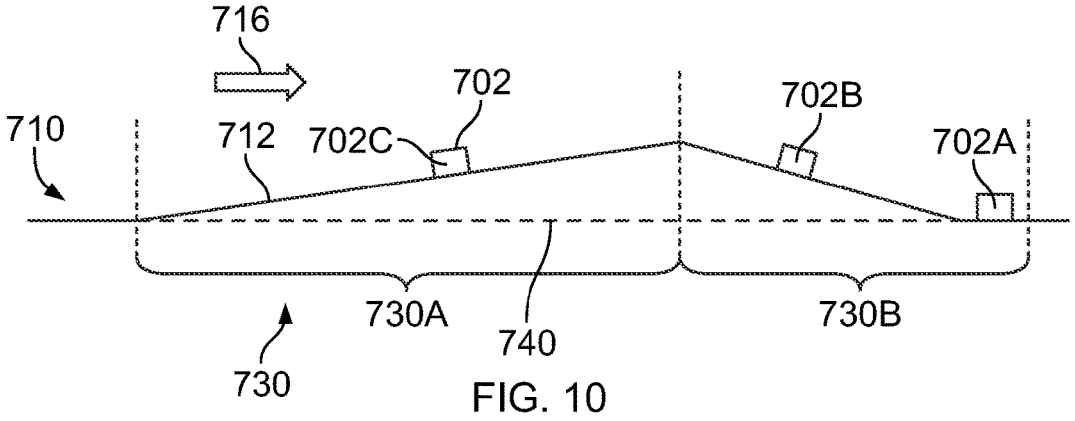
FIG. 10 is a schematic diagram showing three vehicle systems traveling through two different segments of the route within the predetermined time period according to an embodiment.

FIG. 10 is a schematic diagram showing three vehicle systems 702A-C traveling through two different segments 730A, 730B of the route 710 within the predetermined time period according to an embodiment. The network controller 720 (shown in FIG. 7) may be configured to set the permitted PO/W limit based on the route characteristics of the route 710. The route characteristics may include grade, speed limit, curvature, friction, and/or the like. For example, the network controller 720 may set a greater permitted PO/W limit for a first segment of a route than the permitted PO/W limit set for a second segment of the route if the first segment has a higher speed limit than the second segment. A higher speed limit would typically require a greater power output from the vehicle systems 702 to achieve the speed limit than a lower speed limit. The network controller 720 may set the permitted PO/W limit based on averages of one or more of the route characteristics, which accounts for temporary deviations over the length of the segment.

In FIG. 10, the network controller 720 may set a first permitted PO/W limit for a first segment 730A of the route 710 based on the grade of the first segment 730A, and may set a second permitted PO/W limit for a second segment 730B of the route 710 based on the grade of the second segment 730B. The grade refers to the incline or decline of the route 710 relative to a level plane 740. To set the permitted PO/W limits, the network controller 720 may determine (e.g., calculate and/or estimate) the average grade of the segments 730A, 730B. The average grade may be determined based on information received from a track database or calculated based on measurements from sensors, such as optical lasers. In the illustrated embodiment, the first segment 730A along the path 712 has an incline average grade in the direction of travel 716, such that the vehicle systems 702A-C generally travel uphill along the segment 730A, and the second segment 730B has a decline average grade in the direction of travel 716.

The network controller 720 may set the permitted PO/W limits based on the average grades such that a greater permitted PO/W limit is set for segments 730 that have an incline average grade than for segments 730 that have a decline average grade. Furthermore, a greater permitted PO/W limit may be set for a first incline segment than a second incline segment, although both segments are inclined, if the first incline segment has a greater inclination than the second incline segment. For example, a segment 730 of the route 710 that traverses up a steep hill or mountain may have a high permitted PO/W limit or no PO/W limit at all. The vehicle systems 702 traversing up steep segments 730 are thus allowed to utilize a significant amount of the achievable tractive effort to ascend the hill or mountain. Limiting the power output (with a low permitted PO/W limit) may hinder the ability of the vehicle systems 702 to ascend the hill or mountain.

In the illustrated embodiment, the first permitted PO/W limit set by the network controller 720 for the first segment 730A is greater than the second permitted PO/W limit set for the second segment 730B. In a non-limiting example, the first permitted PO/W limit may have an HPT value of 3.5, and the second permitted PO/W limit may have an HPT value of 2.0. The first permitted PO/W limit is enforced by the vehicle systems 702 when traversing the first segment 730A, and the second permitted PO/W limit is enforced by the vehicle systems 702 when traversing the second segment 730B. For example, the first and second vehicle systems 702A, 702B are on the second segment 730B and so travels to avoid exceeding the second permitted PO/W limit (e.g., HPT of 2.0). The third vehicle system 702C is on the first segment 730A and so travels to avoid exceeding the first permitted PO/W limit. Although the third vehicle system 702C is able to generate more power output than the second vehicle system 702B due to the disparity in permitted PO/W limits, the third vehicle system 702C is traveling along an incline grade and is unlikely to catch up to the second vehicle system 702B that is traveling along a decline grade. The second permitted PO/W limit may be set relatively low due to the decline grade. For example, the relatively low permitted PO/W limit may restrain the acceleration of the second vehicle system 702B along the decline to prohibit the vehicle system 702B from catching up to the first vehicle system 702A that is traveling on a level portion of the second segment 730B. The third vehicle system 702C will travel according to the lower, second permitted PO/W limit once the third vehicle system 702C enters the second segment 730B of the route 710.

In one embodiment, the network controller 720 may set the permitted PO/W limits for the segments 730 of the route 710 based only on the route characteristics. For example, the network controller 720 may consider the grade of the segments 730 and potentially other factors, such as precipitation, friction, tilt, curvature, volume of anticipated traffic, road crossings, etc., when setting the permitted PO/W limit independent of the capabilities of the vehicle systems 702 that are scheduled to travel along the route 710, such as the maximum achievable PO/W of the vehicle systems 702. In another embodiment, the network controller 720 may set the permitted PO/W limits based on both the route characteristics (e.g., grade) of the route 710 and the capabilities of the vehicle systems 702 (e.g., maximum achievable PO/W). For example, if the network controller 720 determines an HPT of 2.0 for a given segment 730 of the route 710 based on the maximum achievable PO/W of the vehicle systems 702 scheduled to travel on the segment 730 within a predetermined time period, the network controller 720 may adjust the HPT value up or down depending on the grade of the segment 730. For example, if the grade is an incline, the network controller 720 may set the permitted PO/W limit for the segment 730 to be 2.5 or 3.0 instead of 2.0 to accommodate the additional power output necessary to propel the vehicle systems 702 uphill.

Figure 11:
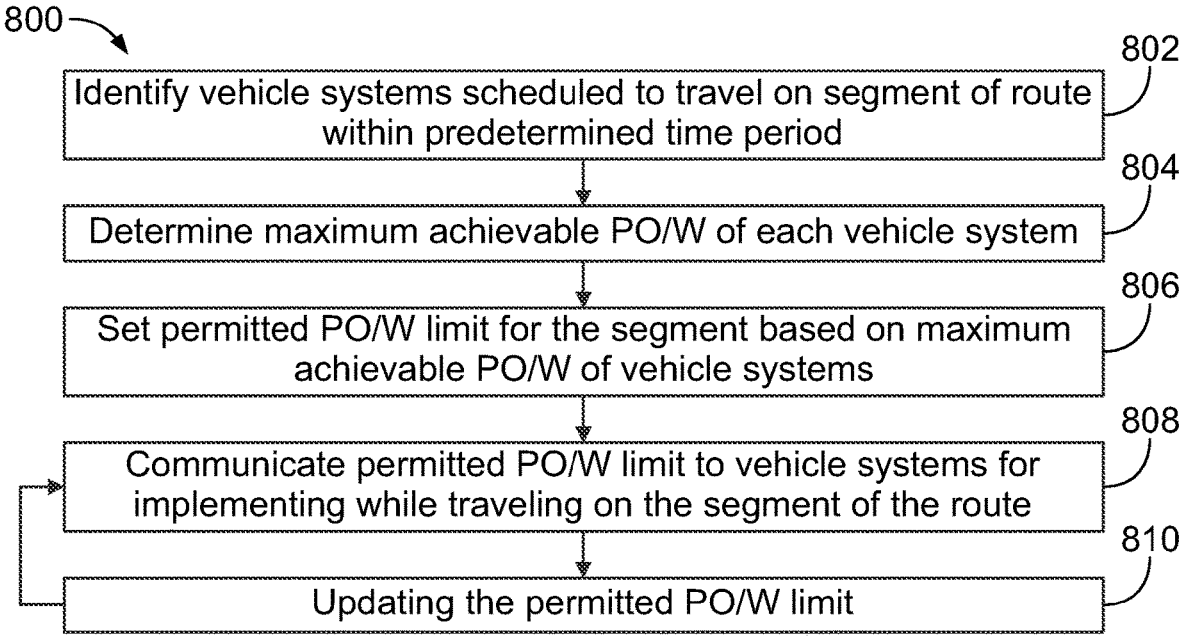
FIG. 11 is a flow chart of a method for controlling a network of plural vehicle systems scheduled to travel on a segment of a route within a predetermined time period according to an embodiment.

FIG. 11 is a flow chart of a method 800 for controlling a network of plural vehicle systems scheduled to travel on a segment of a route within a predetermined time period according to an embodiment. The method 800 is designed to increase overall throughput of the route by restraining the acceleration capabilities of at least some of the vehicle systems to provide more uniform movement of the vehicle systems through the segment of the route. The method 800 may be performed in whole or in part by the network controller 720 shown in FIG. 7, including the one or more processors thereof. The method 800 may include additional steps, fewer steps, and/or different steps than the illustrated flowchart in FIG. 11.

With additional reference to FIGS. 7 through 10, the method 800 beings at 802, at which multiple vehicle systems 702 scheduled to travel along a segment 730 of a route 710 within a predetermined time period are identified.

At 804, a maximum achievable power output per weight (PO/W) of each of the vehicle systems 702 is determined. The maximum achievable PO/W of each of the vehicle systems 702 may be determined based on a network database and/or messages received from the vehicle systems 702.

At 806, a permitted PO/W limit is set for the segment 730 of the route 710 based, at least in part, on the maximum achievable PO/W of one or more of the vehicle systems 702 scheduled to travel on the segment 730 of the route 710. The permitted PO/W limit is less than the maximum achievable PO/W of at least some of the vehicle systems. Optionally, setting the permitted PO/W limit may include ranking the maximum achievable PO/W of the vehicle systems 702 in order from lowest to highest in a distribution, and using the particular maximum achievable PO/W in the distribution that is closest to a pre-selected percentile as the permitted PO/W limit. Optionally, setting the permitted PO/W limit may include determining the lowest maximum achievable PO/W out of the vehicle systems 702 scheduled to travel along the segment 730 of the route 710 in a common direction of travel during the predetermined time period, and using that lowest maximum achievable PO/W as the permitted PO/W limit. Optionally, setting the permitted PO/W limit may include calculating an average or median of the maximum achievable PO/W of each of the vehicle systems 702 scheduled to travel along the segment 730 of the route 710 during the predetermined time period.

At 808, the permitted PO/W limit is communicated to the vehicle systems 702 for the vehicle systems 702 to implement the permitted PO/W limit while traveling on the segment 730 of the route 710. The permitted PO/W limit may be wirelessly communicated from a location offboard the vehicle systems 702, such as a dispatch center, a wayside device, or the like. The vehicle systems 702 may implement the permitted PO/W limit by not exceeding the permitted PO/W limit while the vehicle systems 702 travel along the segment 730 and the permitted PO/W limit is enforced. For example, if a throttle setting of 5 would cause a given vehicle system 702 to generate a power output that exceeds the permitted PO/W limit, the given vehicle system 702 does not implement the throttle setting 5 while the vehicle system 702 travels through the segment 730 and the permitted PO/W limit is enforced. The vehicle systems 702 implement the permitted PO/W limit to increase overall vehicle throughput along the route 710. Optionally, the permitted PO/W limit is enforced automatically by the vehicle systems 702 in response to the vehicle systems 702 entering the segment 730 and/or receiving the permitted PO/W limit via a message.

Optionally, the method 800 may include scheduling enforcement of the permitted PO/W limit. For example, the method 800 may include determining an amount of headway between a trailing vehicle system (e.g., 702D shown in FIG. 9) of the vehicle systems 702 and a leading vehicle system (e.g., 702C shown in FIG. 9) of the vehicle systems 702. The leading vehicle system travels along the route 710 ahead of the trailing vehicle system in a same direction of travel. Enforcement of the permitted PO/W limit by the trailing vehicle system may be postponed for a scheduled duration (or distance of travel) based on the amount of headway. For example, the trailing vehicle system does not enforce the permitted PO/W limit until after the trailing vehicle system travels along the segment 730 of the route 710 for a designated length of time or a designated distance according to the enforcement schedule.

At 810, the permitted PO/W limit is updated. For example, the permitted PO/W limit may be dynamically updated over time based on a change in the group of vehicle systems 702 schedule to travel (or actively traveling) on the segment 730 of the route 710. In an embodiment, the permitted PO/W limit is set at step 806 based on the maximum achievable PO/W of each vehicle system 702 in a first group of vehicle systems 702 scheduled to be commonly located on the segment 730 during a first time period within the predetermined time period. For example, if the predetermined time period is an entire day, the first time period may be a duration of two hours during that day. The permitted PO/W limit may be set based on the particular vehicle systems 702 scheduled to be on the segment 730 during that two hour time window. The vehicle systems 702 on the segment 730 during that two hour time window implement the permitted PO/W limit. The permitted PO/W limit is updated at 810 to reflect a change in the particular vehicle systems 702 on the segment 730 of the route 710. For example, an updated permitted PO/W limit may be set based on the maximum achievable PO/W of each vehicle system 702 in a second group of vehicle systems 702 scheduled to be commonly located on the segment 730 during a second time period that is subsequent to the first time period. For example, the second time period may be a two hour window of time immediately after the first time period within the same day. The second group includes at least one different vehicle system 702 than the first group, attributable to at least one additional vehicle system 702 entering the segment 730 and/or at least one vehicle system 702 exiting the segment 730. After setting the update permitted PO/W, the method 800 returns to 808 and the updated permitted PO/W limit is communicated to the vehicle systems 702. The vehicle systems 702 may enforce or implement the updated permitted PO/W limit during the second time period.

In an embodiment, a system (e.g., a vehicle control system) is provided that includes a communication device and one or more processors operably connected to the communication device. The communication device is located offboard multiple vehicle systems scheduled to travel along a segment of a route within a predetermined time period. The one or more processors are configured to set a permitted power output per weight limit for the vehicle systems. The permitted power output per weight limit is less than a maximum achievable power output per weight of at least some of the vehicle systems. The permitted power output per weight limit is set based on a predetermined power output per weight, one or more route characteristics of the segment of the route, and/or the maximum achievable power output per weight of one or more of the vehicle systems. The permitted power output per weight limit is enforced as a function of time, distance, and/or location along the route. The communication device is configured to communicate the permitted power output per weight limit to the vehicle systems such that the vehicle systems traveling along the segment of the route do not exceed the permitted power output per weight limit while the permitted power output per weight limit is enforced.

Optionally, the one or more processors are configured to set the permitted power output per weight limit based on the maximum achievable power output per weight of each of the vehicle systems scheduled to travel in a first direction along a first path of the route independent of the maximum achievable power output per weight of any of the vehicle systems scheduled to travel in an opposite, second direction along the route or scheduled to travel in the first direction along a different, second path of the route.

Optionally, the segment of the route includes multiple parallel paths on which vehicle systems travel in a first direction along the route. The permitted power output per weight limit is a first permitted power output per weight limit that is set by the one or more processors for the vehicle systems scheduled to travel on a first path of the multiple parallel paths. The one or more processors are configured to set a different, second permitted power output per weight limit for the vehicle systems scheduled to travel on a second path of the multiple parallel paths.

Optionally, the one or more processors are configured to determine a lowest maximum achievable power output per weight out of the vehicle systems scheduled to travel along the segment of the route in a common path and direction of travel within the predetermined time period, and set the permitted power output per weight limit based on the lowest maximum achievable power output per weight.

Optionally, the one or more processors are configured to rank the maximum achievable power output per weight of the vehicle systems scheduled to travel along the segment of the route within the predetermined time period in order from lowest to highest in a distribution, and set the permitted power output per weight limit based on the maximum achievable power output per weight in the distribution that is closest to a pre-selected percentile.

Optionally, the one or more processors are configured to set the permitted power output per weight limit based on statistical metric of the maximum achievable power output per weight of the vehicle systems scheduled to travel along the segment of the route within the predetermined time period.

Optionally, the one or more processors are configured to set the permitted power output per weight limit based on the maximum achievable power output per weight of each of the vehicle systems scheduled to be commonly located on the segment of the route at a first time within the predetermined time period. Optionally, the one or more processors are configured to update the permitted power output per weight limit based on at least one of the vehicle systems entering or exiting the segment of the route.

Optionally, the segment of the route is a first segment of the route and the permitted power output per weight limit is a first permitted power output per weight limit that is set based on an average grade of the first segment. The one or more processors are configured to set a second permitted power output per weight limit based on an average grade of a second segment of the route. The communication device communicates the first and second permitted power output per weight limits to the vehicle systems such that the vehicle systems do not exceed the first permitted power output per weight limit when traversing the first segment of the route and do not exceed the second permitted power output per weight limit when traversing the second segment of the route.

Optionally, the one or more processors are configured to set the permitted power output per weight limit based on the route characteristics of the segment of the route. The route characteristics include grade, speed limit, friction, and/or curvature. Optionally, the one or more processors are configured to set the permitted power output per weight limit based on the grade such that a greater permitted power output per weight limit is set for a segment having an incline average grade than for a segment having a decline average grade.

Optionally, the communication device is configured to communicate an enforcement schedule to the vehicle systems with the permitted power output per weight limit. The enforcement schedule prescribes one or more enforcement periods in which the permitted power output per weight limit is enforced by the vehicle systems. The one or more enforcement periods are characterized by time, location along the route, direction of travel, distance traveled, and/or path along the route. Optionally, the one or more processors are further configured to determine the enforcement schedule based at least on schedules of the vehicle systems.

Optionally, the one or more processors are further configured to determine an amount of headway between a trailing vehicle system of the vehicle systems and a leading vehicle system of the vehicle systems that travels along the segment of the route ahead of the trailing vehicle system in a same direction of travel. The one or more processors are configured to postpone enforcing the permitted power output per weight limit on the trailing vehicle system for an amount of time or a distance of travel of the trailing vehicle system along the segment of the route based on the amount of headway.

Optionally, the one or more processors and the communication device are commonly located at a dispatch center or a wayside device.

In one or more embodiments, a method is provided that includes identifying multiple vehicle systems scheduled to travel along a segment of a route within a predetermined time period, and determining a maximum achievable power output per weight of each of the vehicle systems. The method also includes setting a permitted power output per weight limit for the segment of the route. The permitted power output per weight limit is less than the maximum achievable power output per weight of at least some of the vehicle systems and is set based on the maximum achievable power output per weight of one or more of the vehicle systems. The method includes communicating the permitted power output per weight limit to the vehicle systems such that the vehicle systems do not exceed the permitted power output per weight limit while the vehicle systems travel along the segment of the route and the permitted power output per weight limit is enforced.

Optionally, the maximum achievable power output per weight of each of the vehicle systems is determined based on a network database and/or messages received from the vehicle systems.

Optionally, setting the permitted power output per weight limit is based on ranking the maximum achievable power output per weight of the vehicle systems scheduled to travel along the segment of the route during the predetermined time period in order from lowest to highest in a distribution.

Optionally, the route includes a first path and a second path. The permitted power output per weight limit is a first permitted power output per weight limit that is set based on the maximum achievable power output per weight of a first group of the vehicle systems scheduled to travel on the first path. The method further includes setting a second permitted power output per weight limit based on the maximum achievable power output per weight of a second group of the vehicle systems scheduled to travel on the second path.

Optionally, the permitted power output per weight limit is set based on the maximum achievable power output per weight of each vehicle system in a first group of vehicle systems scheduled to be commonly located on the segment of the route during a first time period within the predetermined time period. The permitted power output per weight limit is communicated to the vehicle systems for enforcement during the first time period. Optionally, the method further includes setting an updated permitted power output per weight limit based on the maximum achievable power output per weight of each vehicle system in a second group of vehicle systems scheduled to be commonly located on the segment of the route during a second time period subsequent to the first time period. The second group including at least one different vehicle system than the first group. The method includes communicating the updated permitted power output per weight limit to the vehicle systems for enforcement during the second time period.

Optionally, the method further includes determining an amount of headway between a trailing vehicle system of the vehicle systems and a leading vehicle system of the vehicle systems. The leading vehicle system traveling along the route ahead of the trailing vehicle system in a same direction of travel. The method includes scheduling enforcement of the permitted power output per weight limit by the trailing vehicle system based on the amount of headway.

In one or more embodiments, a system is provided that includes a network controller including one or more processors. The network controller is configured to identify multiple vehicle systems scheduled to travel along a segment of a route within a predetermined time period and determine a maximum achievable power output per weight of each of the vehicle systems. The network controller is further configured to set a permitted power output per weight limit for the segment of the route. The permitted power output per weight limit is set based on the maximum achievable power output per weight of one or more of the vehicle systems and is less than the maximum achievable power output per weight of at least some of the vehicle systems. The system also includes a communication device operably connected to the network controller. The communication device is configured to communicate the permitted power output per weight limit to the vehicle systems such that the vehicle systems implement the permitted power output per weight limit while traveling along the segment of the route In an embodiment, a system includes a locator device, a communication circuit, and one or more processors. The locator device is disposed onboard a trailing vehicle system that is configured to travel along a route behind a leading vehicle system that travels along the route in a same direction of travel as the trailing vehicle system. The locator device is configured to determine a location of the trailing vehicle system along the route. The communication circuit is disposed onboard the trailing vehicle system. The communication circuit is configured to periodically receive a status message that includes a location of the leading vehicle system. The one or more processors are onboard the vehicle system and are operably connected to the locator device and the communication circuit. The one or more processors are configured to verify that a power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The one or more processors are further configured to monitor a trailing distance between the trailing vehicle system and the leading vehicle system based on the respective locations of the leading and trailing vehicle systems. Responsive to the trailing distance being less than a first proximity distance relative to the leading vehicle system, the one or more processors are configured to set an upper permitted power output limit for the trailing vehicle system that is less than the upper power output limit of the trailing vehicle system to reduce an effective power-to-weight ratio of the trailing vehicle system.

Optionally, the one or more processors set the upper permitted power output limit for the trailing vehicle system such that the effective power-to-weight ratio of the trailing vehicle system based on the upper permitted power output limit is no greater than the power-to-weight ratio of the leading vehicle system.

Optionally, the trailing vehicle system includes at least one propulsion system that provides tractive effort to move the trailing vehicle system along the route. The power-to-weight ratio of the trailing vehicle system represents a total available tractive effort that can be provided by the at least one propulsion system divided by a total weight of the trailing vehicle system.

Optionally, the communication circuit is configured to receive the status message that includes the location of the leading vehicle system from at least one of the leading vehicle system, a dispatch location, or an aerial device.

Optionally, responsive to the trailing distance being less than a first proximity distance, the one or more processors set the upper permitted power output limit for the trailing vehicle system by restricting throttle settings used to control propulsion of the trailing vehicle system to exclude at least a top throttle setting that is associated with the upper power output limit of the trailing vehicle system.

Optionally, the one or more processors control the movement of the trailing vehicle system along an upcoming section of the route according to the upper permitted power output limit such that a power output of the trailing vehicle system for propelling the trailing vehicle system along the route does not exceed the upper permitted power output limit.

Optionally, the one or more processors are configured to continue monitoring the trailing distance subsequent to setting the upper permitted power output limit of the trailing vehicle system. Responsive to the trailing distance being greater than a second proximity distance relative to the leading vehicle system, the one or more processors are configured to increase the upper permitted power output limit of the trailing vehicle system such that the effective power-to-weight ratio of the trailing vehicle system that results is greater than the power-to-weight ratio of the leading vehicle system. The second proximity distance extends farther from the leading vehicle system than the first proximity distance. Optionally, the one or more processors increase the upper permitted power output limit to an adjusted upper permitted power output limit that is at least one of equal to or less than the upper power output limit of the trailing vehicle system.

Optionally, the first proximity distance extends rearward from the leading vehicle system to a first proximity threshold. The one or more processors determine that the trailing distance is less than the first proximity distance responsive to a designated portion of the trailing vehicle system being more proximate to the leading vehicle system than a proximity of the first proximity threshold to the leading vehicle system.

Optionally, the one or more processors of the trailing vehicle system determine the power-to-weight ratio of the leading vehicle system by at least one of retrieving the power-to-weight ratio of the leading vehicle system from storage in a memory onboard the trailing vehicle system or by the communication circuit receiving the power-to-weight ratio in a message from at least one of the leading vehicle system or a dispatch location.

Optionally, the one or more processors of the trailing vehicle system determine the power-to-weight ratio of the trailing vehicle system by at least one of retrieving the power-to-weight ratio of the leading vehicle system from storage in a memory onboard the trailing vehicle system or by the communication circuit receiving the power-to-weight ratio in a message from a dispatch location.

In another embodiment, a method (e.g., for controlling movement of a trailing vehicle system) includes determining a power-to-weight ratio of a leading vehicle system that is on a route and disposed ahead of a trailing vehicle system on the route in a direction of travel of the trailing vehicle system. The method includes verifying that the power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The method also includes monitoring a trailing distance between the trailing vehicle system and the leading vehicle system along the route. The method further includes, responsive to the trailing distance being less than a first proximity distance relative to the leading vehicle system, setting an upper permitted power output limit that is less than the upper power output limit. An effective power-to-weight ratio of the trailing vehicle system based on the upper permitted power output limit is no greater than the power-to-weight ratio of the leading vehicle system.

Optionally, the method further includes controlling the movement of the trailing vehicle system along an upcoming section of the route according to the upper permitted power output limit. The movement is controlled according to the upper permitted power output limit such that a power output of the trailing vehicle system for propelling the trailing vehicle system along the route does not exceed the upper permitted power output limit.

Optionally, the power-to-weight ratio of the leading vehicle system is received onboard the trailing vehicle system in a message that is received by a communication circuit of the trailing vehicle system.

Optionally, the trailing distance is monitored by periodically receiving a status message that includes an updated location of the leading vehicle system and comparing the updated location of the leading vehicle system to a current location of the trailing vehicle system determined via a locator device onboard the trailing vehicle system.

Optionally, responsive to the trailing distance being less than a first proximity distance, the upper permitted power output limit of the trailing vehicle system is set by restricting throttle settings used to control propulsion of the trailing vehicle system to exclude at least a top throttle setting that is associated with the upper power output limit of the trailing vehicle system.

Optionally, the method further includes monitoring the trailing distance subsequent to setting the upper permitted power output limit of the trailing vehicle system. Responsive to the trailing distance being greater than a second proximity distance relative to the leading vehicle system, the method includes increasing the upper permitted power output limit of the trailing vehicle system such that the effective power-to-weight ratio of the trailing vehicle system that results is greater than the power-to-weight ratio of the leading vehicle system. The second proximity distance extends farther from the leading vehicle system than the first proximity distance. Optionally, the upper permitted power output limit is increased to an adjusted upper permitted power output limit that is at least one of equal to or less than the upper power output limit of the trailing vehicle system.

Optionally, the first proximity distance extends rearward from the leading vehicle system to a first proximity threshold. The trailing distance is determined to be less than the first proximity distance responsive to a designated portion of the trailing vehicle system being disposed between the first proximity threshold and the leading vehicle system.

Optionally, the first proximity distance is greater than a sum of at least a safe braking distance for the trailing vehicle system and a response time distance for the trailing vehicle system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

As used herein, the terms "system," "device," or "unit" may include a hardware and/or software system that operates to perform one or more functions. For example, a unit, device, or system may include a computer processor, controller, or other logic-based device that performs operations based on instructions stored on a tangible and non-transitory computer readable storage medium, such as a computer memory. Alternatively, a unit, device, or system may include a hard-wired device that performs operations based on hard-wired logic of the device. The units, devices, or systems shown in the attached figures may represent the hardware that operates based on software or hardwired instructions, the software that directs hardware to perform the operations, or a combination thereof. The systems, devices, or units can include or represent hardware circuits or circuitry that include and/or are connected with one or more processors, such as one or computer microprocessors.

What is claimed is:

1. A system comprising:

one or more processors configured to be communicatively connected to a locator device disposed onboard a vehicle system and an audio emitter disposed onboard the vehicle system, the one or more processors configured to:

monitor a location of the vehicle system as the vehicle system travels along a first route based on signals generated by the locator device;

identify a crossing, at which a second route intersects the first route, that is upcoming based on the location of the vehicle system and a known location of the crossing stored within a database accessible to the one or more processors;

determine, via the database, whether emitting an audible warning sequence is appropriate when the vehicle system approaches the crossing; and in response to determining that the audible warning sequence is appropriate, control the audible warning emitter to generate the audible warning sequence as the vehicle system approaches the crossing.

2. The system of claim 1, wherein the database includes the known location of the crossing and additional information associated with the crossing, the additional information comprising one or more of whether the crossing is public or private, whether the crossing is marked or unmarked, or whether the crossing is subject to a noise restriction.

3. The system of claim 2, wherein in response to determining that the crossing is subject to the noise restriction that provides a designated threshold noise level, the one or more processors are configured to control the audible warning emitter to generate the audible warning sequence at a noise level that does not exceed the designated threshold noise level as the vehicle system approaches the crossing.

4. The system of claim 2, wherein in response to determining that the crossing is subject to the noise restriction that prohibits audible warnings during a designated time period, the one or more processors are configured to:

estimate, via a clock, a time that the vehicle system will approach the crossing; and control the audible warning emitter to generate the audible warning sequence as the vehicle system approaches the crossing in response to determining that the time that the vehicle system will approach the crossing is not within the designated time period.

5. The system of claim 1, wherein, in response to determining that emitting the audible warning sequence is not appropriate, the one or more processors are configured to control the audible warning emitter to not generate the audible warning sequence as the vehicle system approaches the crossing.

6. The system of claim 1, wherein the one or more processors are further configured to:

monitor a speed of the vehicle system on the first route; and determine a location along the first route at which to initiate the audible warning emitter to generate the audible warning sequence based on the speed, the known location of the crossing, and a predetermined duration of the audible warning sequence.

7. The system of claim 1, wherein the one or more processors are further configured to:

monitor a speed of the vehicle system on the first route;

calculate, based on the speed, the location of the vehicle system, and the known location of the crossing, an estimated amount of time remaining until the vehicle system reaches the crossing and control a display device to display a countdown that represents the estimated amount of time remaining until the vehicle system reaches the crossing.

8. The system of claim 1, wherein the one or more processors are further configured to determine, based at least on the location of the vehicle system over time and the known location of the crossing, a proximity of the vehicle system to the crossing, wherein the one or more processors are further configured to control a display device to display, as the vehicle system travels towards the crossing, a series of successively shorter distances over time that represent the proximity of the vehicle system to the crossing.

9. The system of claim 1, wherein the one or more processors are configured, in response to determining whether emitting the audible warning sequence is appropriate when approaching the crossing, to control a display device to display an indicator that indicates at least one of whether the audible warning sequence is appropriate when approaching the crossing or whether the one or more processors are going to control the audible warning emitter to generate the audible warning sequence as the vehicle system approaches the crossing.

10. The system of claim 1, wherein the database stored in a memory device onboard the vehicle system.

11. The system of claim 1, wherein the vehicle system is a train and the first route is a railroad track.

12. A method comprising:

monitoring a location of a vehicle system as the vehicle system travels along a first route based on signals generated by a locator device disposed onboard the vehicle system;

identifying a crossing, at which a second route intersects the first route, that is upcoming based on the location of the vehicle system and a known location of the crossing stored within a database accessible to the one or more processors;

determining, via the one or more processors accessing the database, whether emitting an audible warning sequence is appropriate when the vehicle system approaches the crossing; and in response to determining that the audible warning sequence is appropriate, controlling an audible warning emitter disposed onboard the vehicle system, via the one or more processors, to generate the audible warning sequence as the vehicle system approaches the crossing.

13. The method of claim 12, wherein determining whether emitting the audible warning sequence is appropriate comprises determining one or more of whether the crossing is public or private, whether the crossing is marked or unmarked, or whether the crossing is subject to a noise restriction.

14. The method of claim 12, wherein said determining whether emitting the audible warning sequence is appropriate comprises determining that the crossing is subject to a noise restriction that provides a designated threshold noise level, and wherein said controlling the audible warning emitter to generate the audible warning sequence as the vehicle system approaches the crossing comprises controlling the audible warning emitter to generate the audible warning sequence at a noise level that does not exceed the designated threshold noise level.

15. The method of claim 12, wherein determining whether emitting the audible warning sequence is appropriate comprises determining that the crossing is subject to a noise restriction that prohibits audible warnings during a designated time period, and the method further comprises:

estimating a time that the vehicle system will approach the crossing; and determining that the time that the vehicle system will approach the crossing is not within the designated time period before the audible warning emitter is controlled to generate the audible warning sequence.

16. The method of claim 12, wherein, in response to determining that emitting the audible warning sequence is not appropriate, the method comprises controlling the audible warning emitter to not generate the audible warning sequence as the vehicle system approaches the crossing.

17. The method of claim 12, further comprising:

monitoring a speed of the vehicle system on the first route; and determining a location along the first route at which to initiate the audible warning emitter to generate the audible warning sequence based on the speed, the known location of the crossing, and a predetermined duration of the audible warning sequence.

18. The method of claim 12, further comprising:

monitoring a speed of the vehicle system on the first route;

calculating, based on the speed, the location of the vehicle system, and the known location of the crossing, an estimated amount of time remaining until the vehicle system reaches the crossing; and controlling a display device to display a countdown that represents the estimated amount of time remaining until the vehicle system reaches the crossing.

19. The method of claim 12, further comprising:

in response to determining whether emitting the audible warning sequence is appropriate when approaching the crossing, controlling a display device to display an indicator that indicates at least one of whether the audible warning sequence is appropriate when approaching the crossing or whether the one or more processors are going to control the audible warning emitter to generate the audible warning sequence as the vehicle system approaches the crossing.

20. A vehicle system comprising:

a locator device;

an audible warning emitter;

a speed sensor; and a controller disposed communicatively connected to the located device, the audible warning emitter, and the speed sensor, the controller comprising one or more processors and a memory device, wherein the one or more processors are configured to:

monitor a location of the vehicle system as the vehicle system travels along a first route based on signals generated by the locator device;

monitor a speed of the vehicle system based on signals generated by the speed sensor;

identify a crossing, at which a second route intersects the first route, that is upcoming based on the location of the vehicle system and a known location of the crossing stored within the memory device;

determine, via crossing information stored within the memory device, that emitting an audible warning sequence is appropriate when the vehicle system approaches the crossing;

determine a location along the first route at which to initiate the audible warning sequence based on the speed of the vehicle system, the known location of the crossing, and a predetermined duration of the audible warning sequence; and control the audible warning emitter to generate the audible warning sequence upon the vehicle system reaching the location along the first route at which to initiate the audible warning sequence.

* * * * *